US006189180B1

(12) United States Patent
Hato et al.

(10) Patent No.: US 6,189,180 B1
(45) Date of Patent: Feb. 20, 2001

(54) SUCTION TOOL FOR AN ELECTRIC VACUUM CLEANER

(75) Inventors: Shigenori Hato, Kishiwada; Mikio Yagi, Osaka; Noriaki Miyoshi, Sakai; Kiyoshi Ishii, Nishinomiya; Yuji Ohnishi, Sakai, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/266,940

(22) Filed: Mar. 12, 1999

Related U.S. Application Data

(62) Division of application No. 08/755,801, filed on Dec. 31, 1996, now Pat. No. 5,901,411.

(30) Foreign Application Priority Data

| | | |
|---|---|---|
| Jan. 23, 1996 | (JP) | 8-009325 |
| Apr. 9, 1996 | (JP) | 8-86359 |
| Jul. 22, 1996 | (JP) | 8-191731 |

(51) Int. Cl.[7] ..... A47L 9/04
(52) U.S. Cl. ..... 15/380; 15/364
(58) Field of Search ..... 15/363, 364, 377, 15/380, 387

(56) References Cited

U.S. PATENT DOCUMENTS

| | | | | |
|---|---|---|---|---|
| 800,292 | * | 9/1905 | Gunderson | 15/380 |
| 1,336,760 | * | 4/1920 | Stewart | 15/380 |
| 1,773,961 | | 8/1930 | Dance . | |
| 1,820,350 | | 8/1931 | Dance . | |
| 2,107,571 | * | 2/1938 | Kirby | 15/380 |
| 2,570,679 | * | 10/1951 | Huber | 15/380 |
| 2,635,278 | | 4/1953 | Belknap . | |
| 2,926,370 | * | 3/1960 | Wessel | 15/380 |
| 3,775,804 | * | 12/1973 | Hoener | 15/380 |
| 4,014,067 | | 3/1977 | Bates . | |
| 4,020,526 | | 5/1977 | Johansson . | |
| 4,272,861 | | 6/1981 | Notta et al. . | |
| 4,295,243 | * | 10/1981 | King | 15/380 |
| 4,372,004 | | 2/1983 | Vermillion . | |
| 4,375,117 | * | 3/1983 | Lyman | 15/377 |
| 4,430,768 | | 2/1984 | Novinger . | |
| 4,939,808 | * | 7/1990 | Roden et al. | 15/380 |
| 5,557,822 | | 9/1996 | Yagi et al. . | |

FOREIGN PATENT DOCUMENTS

| | | | |
|---|---|---|---|
| 2-428400 | | 1/1976 | (DE) . |
| 2428400 | | 1/1976 | (DE) . |
| 0630604 | | 12/1994 | (DE) . |
| 0451401 | | 10/1991 | (EP) . |
| 385699 | * | 1/1933 | (GB) 15/380 |
| 2028639 | | 3/1980 | (GB) . |
| 3-41634 | | 9/1991 | (JP) . |
| 8-56875 | | 3/1996 | (JP) . |

* cited by examiner

*Primary Examiner*—Terrence R. Till

(57) ABSTRACT

A suction tool for an electric vacuum cleaner includes: a suction tool body which is connected to the vacuum cleaner body and has a suction inflow passage therein for conducting a suction air stream from a suction port, to the vacuum cleaner body; and a movable brush which is provided inside the suction inflow passage formed in the suction tool body and is driven by a driver device. In this tool, the movable brush sways and reciprocates back and forth about a support shaft, perpendicular to the direction of the suction inflow stream. Alternatively, the tool may have a linear motor which operates so as to reciprocate a rod which is liked at one end of it with oscillatory plate pivoted inside the suction tool. Further, this movable brush may be formed of a unit which is composed of a sweeping member having a pair of front and rear sweeping parts and a moving brushing part embedded in between, wherein the front sweeping part is shorter than the rear sweeping part.

10 Claims, 27 Drawing Sheets

SUCTION TOOL FOR AN ELECTRIC VACUUM CLEANER

This application is a divisional of application Ser. No. 08/775,801, filed on Dec. 31, 1996 now U.S. Pat. No. 5,901,411, the entire contents of which are hereby incorporated by reference.

BACKGROUND OF THE INVENTION (1) Field of the Invention

The present invention relates to improvement of the suction tool for an electric vacuum cleaner.

(2) Description of the Prior Art

As an example of a suction tool for an electric vacuum cleaner, disclosed in for example, Japanese Utility Model Publication Hei 3 No. 41,634 is a configuration which as shown in FIGS. 1 and 2 includes: inside a suction tool body 33 made up of upper and lower casings 31 and 32 being butted to each other, a suction inflow passage 36 for conducting the suction air stream from a suction port 34 which is an opening in the lower surface of suction tool body 33, to the vacuum cleaner (not shown) via a joint tube 35; a motor 37; and a rotary brush 40 which is driven to rotate about a support shaft 39 through a belt 38 by the driving force of the motor 37.

Since, in the above suction tool, rotary brush 40 rotates about support shaft 39, a space which is greater than the dimension of the radius of rotary brush 40 was needed around the brush inside suction tool body 33, thus increasing the size of the suction tool. There was also a risk of danger in that if the hand touched the rotary brush 40, the fingers might be drawn into the tool by the brush. Further, there was an area which the bristles of rotary brush 40 could not reach, and the tool had a poor scrubbing effect of dust and dirt in this area.

SUMMARY OF THE INVENTION

The invention has been devised in order to solve the above problems, and it is therefore an object of the invention to provide a suction tool for an electric vacuum cleaner which can be itself compact and safer. It is another object of the invention to provide a suction tool for an electric vacuum cleaner which is improved in scrubbing efficiency of dust and dirt.

The invention has been achieved to attain the above objects, and the gist of the invention is as follows:

In accordance with the first aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body; and a movable brush which is provided in the middle of the suction inflow passage inside the suction tool body and is driven by a driver device, wherein the movable brush which is driven by a motor or turbine, is arranged so as to sway and reciprocate back and forth about a support shaft, perpendicular to the direction of the suction inflow stream.

In accordance with the second aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body; and a movable brush which is provided in the middle of the suction inflow passage inside the suction tool body and is driven by a driver device, wherein the movable brush which is driven by a motor of turbine, is arranged so as to linearly reciprocate in the left and right directions relative to the inflow direction of the suction air stream.

In accordance with the third aspect of the invention, in the electric vacuum cleaner having the above first or second feature, the movable brush is detachable and has a number of bundles of bristles on one of the upper or lower sides and a blade on the other side.

Next, in accordance with the fourth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body; and a rotary brush which is provided in the middle of the suction inflow passage inside the suction tool body and is driven by a driver device, wherein a second brush which sways and reciprocates back and forth about a support shaft, perpendicular to the direction of the suction inflow stream, is arranged in front of the rotary brush which is driven by a motor or turbine.

In accordance with the fifth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body; and a rotary brush which is provided in the middle of the suction inflow passage inside the suction tool body and is driven by a driver device, wherein a second brush which sways and reciprocates about a support shaft in the left and right directions perpendicular to the inflow direction of the suction air stream, is arranged at a side of the rotary brush which is driven by a motor or turbine.

In accordance with the sixth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body; and a movable brush which is provided in the middle of the suction inflow passage inside the suction tool body and is driven by a driver device, wherein the movable brush is supported movably inside suction tool body so that the brush is arranged along, and can sway back and forth relative to, the inflow direction of the suction air stream, and the driver device comprises a linear motor or solenoid.

In accordance with the seventh aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body;

a movable brush which is provided in the middle of the suction inflow passage inside the suction tool body and is driven by a driver device;

an oscillator plate which has the movable brush at the lower end thereof and is pivoted inside the suction tool body so as to sway back and forth along the inflow direction of the suction air stream; and a linear motor which constitutes the driver device, and operates so as to reciprocate a rod which is linked at one end thereof with the oscillator plate, wherein the movable brush attached to the oscillator plate sways to perform cleaning, following the reciprocating motion of the rod due to the operation of the linear motor.

In accordance with the eighth aspect of the invention, in the suction tool for an electric vacuum cleaner having the above seventh feature, the driver device is constructed by a solenoid.

Further, in accordance with the ninth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body;

a movable brush which is provided in the middle of the suction inflow passage inside the suction tool body and is driven by a driver device;

an oscillator plate which is pivoted inside the suction tool body so as to sway back and forth along the inflow direction of the suction air stream;

a sweeping member made from rubber, attached to the lower end of the oscillator plate;

a movable brush which is attached to the lower end of the oscillator plate behind the sweeping member so as to project downward; and a linear motor or solenoid which constitutes the driver device and operates so as to reciprocate a rod which is linked at one end thereof with the oscillator plate, wherein the movable brush attached to the oscillator plate sways to perform cleaning, following the reciprocating motion of the rod due to the operation of the linear motor or solenoid.

Next, in accordance with the tenth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body; and a movable brush unit which is provided in the middle of the suction inflow passage inside the suction tool body and reciprocates back and forth by a driver device, the movable brush unit being composed of a unit base frame extending along the suction port and a movable brush assembly attached to the unit base frame, and the movable brush assembly is composed of a sweeping member which is made from a rubber material and includes a base part which fits into the unit base frame, a pair of front and rear sweeping parts which extend downward in parallel to one another with a gap therebetween, from the lower side of the base part, and a movable brush embedded in the gap, wherein the front sweeping part is shorter than the rear sweeping part.

In accordance with the eleventh aspect of the invention, in the suction tool for an electric vacuum cleaner having the above tenth feature, wherein the pivotal shaft of the movable brush unit is supported through an anti-vibration mechanism.

In accordance with the twelfth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body; and a movable brush unit which is provided in the middle of the suction inflow passage inside the suction tool body and reciprocates back and forth by a driver device, and the movable brush unit is composed of a unit base frame extending along the suction port and a movable brush assembly attached to the unit base frame, the movable brush assembly being composed of a sweeping member which is made from a rubber material and includes a base part which fits into the unit base frame, a pair of front and rear sweeping parts which extend downward in parallel to one another with a gap therebetween, from the lower side of the base part, and a movable brush embedded in the gap, wherein the movable brush is impregnated with liquid paraffin.

In accordance with the thirteenth aspect of the invention, the suction tool for an electric vacuum cleaner having the above tenth or twelfth feature, further includes an angular motion regulatory mechanism for regulating the reciprocating motion of the movable brush about the pivotal shaft.

In accordance with the fourteenth aspect of the invention, in the suction tool for an electric vacuum cleaner having the above thirteenth feature, the angular motion regulatory mechanism has such a structure that a rotary member fixed to the pivotal shaft is angularly restricted by an immovable member, and a leaf spring is interposed between the rotary member and the immovable member so that braking force is generated through the leaf spring within the range in which the rotary member is movable.

In accordance with the fifteenth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body;

a floor polisher assembly which is attached to the lower side of the suction tool body so as to slide back and forth;

a linear motor or solenoid for reciprocating a rod provided inside the suction tool body;

a transmission device which transmits the motion of the rod to the floor polisher assembly so as to reciprocate the floor polisher assembly back and froth in the undersurface of the suction tool body, following the reciprocating motion of the rod due to the linear motor or solenoid.

In accordance with the sixteenth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body;

a polishing plate which has a polisher cloth attached on the plate surface thereof and is mounted in the undersurface of the suction tool body so as to be able to vibrate up and down; and a vibrating cam which is driven by a driver device provided inside the suction tool body and vibrates the polishing plate up and down.

In accordance with the seventeenth aspect of the invention, in the suction tool for an electric vacuum cleaner having the above sixteen feature, the polisher cloth is removably attached to the polishing plate.

In accordance with the eighteenth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body;

a polishing plate which has a polisher cloth attached on the plate surface thereof and is mounted in the under-surface of the suction tool body so as to be able to vibrate up and down; and a vibrating cam which is driven by a driver device provided inside the suction tool body and vibrates the polishing plate up and down, wherein when the suction tool body is placed on the floor surface, the vibrating cam becomes mechanically linked with the polishing plate so that the motion of the vibrating cam is transmitted to the polishing plate to vibrate the polishing plate.

In accordance with the nineteenth aspect of the invention, a suction tool for an electric vacuum cleaner includes:

a suction tool body which is connected to the vacuum cleaner body and has a suction inflow passage therein for conducting a suction air stream from a suction port opening on the bottom face thereof, to the vacuum cleaner body;

a polishing plate which has a polisher cloth attached on the plate surface thereof and is mounted in the under-surface of the suction tool body so as to be able to vibrate up and down; and a vibrating cam which is driven by a driver device provided inside the suction tool body and vibrates the polishing plate up and down, a floor polishing device having a suction inflow passage communicating with the suction tool body.

As has been seen in the above description, each structure of the invention is thus configured, and the effects of the features of the invention are as follows:

In the first configuration of the invention, wherein the movable brush is reciprocated back and forth about the support shaft, the space required for the oscillation is reduced as compared to the rotational space that was occupied by a rotary brush. In accordance with the movable brush that sways and reciprocates, there is no risk of danger that the fingers might be drawing in.

In the second configuration of the invention, wherein the movable brush is linearly reciprocated left and right, similarly to the case of the first configuration of the invention, the space required for the oscillation is reduced as compared to the rotational space that was occupied by a rotary brush. In accordance with the movable brush that sways and reciprocates, there is no risk of danger that the fingers might be drawing in.

In accordance with the third configuration of the invention, depending upon the type of the material on the floor, such as tatami mat (straw matting), carpet, rug, etc;, either brush bristles or blade can be selectively used by detaching a single movable brush and reversing it upside down.

In accordance with the fourth configuration of the invention, the dust and dirt in front of the rotary brush, that is, in the area which cannot be reached by the conventional rotary brush, can be scrubbed by the second brush.

In accordance with the fifth configuration of the invention, the dust and dirt at the side, either left or right, of the rotary brush, that is, in the area which cannot be reached by the conventional rotary brush, can be scrubbed by the second brush.

In accordance with sixth configuration of the invention, the movable brush is swayed by a linear motor or solenoid to perform cleaning of the floor surface. As a result, the provision of only a movable brush which simply oscillates is so effective that it is possible to make the suction tool compact as compared to the conventional brush which was rotated. Still more, the driver device is constituted of a linear motor or-solenoid, needing fewer parts, thus a further reduction in size can be expected.

In accordance with seventh configuration of the invention, the oscillator plate is reciprocated through the rod by the operation of the linear motor, so that a movable brush provided at the lower end of the oscillator plate performs cleaning. Accordingly, only a movable brush is simply made to oscillate, so that it is possible to make the suction tool compact as compared to the conventional brush which was rotated. Still more, since the driver device is constituted of a linear motor, the driving force of the motor is transmitted to the oscillator plate using only a rod. This configuration needs very few parts, so that a further reduction in size can be expected.

In accordance with the eighth configuration of the invention, a solenoid is used in place of the linear motor in the above seventh configuration, so that it is possible to produce a suction tool for an electric vacuum cleaner with a few parts, as in the seventh configuration.

In accordance with ninth configuration of the invention, the oscillator plate is reciprocated through the rod by the operation of the linear motor or solenoid, so that the movable brush and sweeping member provided at the lower end of the oscillator plate performs cleaning. Accordingly, the provision of only a movable brush is simply made to oscillate, so that it is possible to make the suction tool compact as compared to the conventional brush which was rotated. Still more, since the driver device is constituted of a linear motor or solenoid, the driving force of the motor is transmitted to the oscillator plate using only a rod. This configuration needs very few parts, so that a further reduction in size can be expected. Further, the provision of a sweeping member enables lint and fluff adhering to carpet etc., to be scrubbed efficiently, thus enhancing cleaning efficiency.

In accordance with the tenth configuration of invention, the movable brush unit is swayed and reciprocated by the operation of the driver device so that the movable brush and sweeping member of the movable brush unit performs cleaning. Accordingly, the provision of only a movable brush which simply oscillates is so effective that it is possible to make the suction tool compact as compared to the conventional brush which was rotated. Still more, since the front sweeping part is formed shorter than the rear sweeping part, the structure enables lint and fluff adhering to carpet etc., to be scrubbed efficiently, thus enhancing cleaning efficiency.

In accordance with the eleventh configuration of the invention, during the operation of the movable brush unit, cleaning is performed whilst vibrations are absorbed by the anti-vibration mechanism. Thus, if the movable brush unit vibrates, the vibration can be alleviated so as not to be transmitted to the whole part of the suction tool. Therefore, it is possible to provide an electric vacuum cleaner having good handling, in which the vibration will not-spread to the hands of the user.

In accordance with the twelfth configuration of the invention, since the movable brush is impregnated with liquid paraffin, this feature can offer a simple floor polishing effect for the flooring.

Since the thirteenth configuration of the invention, further has an angular motion regulatory mechanism for regulating the reciprocating motion of the movable brush about the pivotal shaft, the vibration of the movable brush as well as deformation of the unit base frame is inhibited during the swaying and reciprocating motion, thus making it possible to obtain a reliable sweeping effect of the movable brush.

In accordance with the fourteenth configuration of the invention, since a leaf spring is interposed between the rotary member and the immovable member, braking force is generated through the leaf spring within the range in which the rotary member is movable. As a result, it is possible to reliably inhibit the vibration of the movable brushing unit by an inexpensive method In accordance with the fifteenth configuration of the invention, since the floor polishing assembly moves back and forth in the undersurface of the suction tool body by the operation of the linear motor or solenoid, the electric vacuum cleaner can be used as a floor polisher, thus it is possible to provide an electric vacuum cleaner having good handling.

In accordance with the sixteenth configuration of the invention, the polisher cloth polishes the floor surface whilst the polishing plate vibrates up and down, so that it is possible to polish the floor surface without strongly rubbing it. As a result, polishing can be performed without damage to the floor surface.

In accordance with the seventeenth feature of the invention, the polisher cloth is freely detached from the polishing plate. This configuration permits the polisher cloth to be replaced in a markedly simple manner.

In accordance with the eighteenth configuration of the invention, the vibrating cam becomes mechanically linked with the polishing plate so that the motion of the vibrating cam can be transmitted to the polishing plate so to vibrate only when the suction tool body is placed on the floor surface. As a result, when the suction tool body is lifted, in other words, when the user lifts up the suction tool body for transfer, or any other reason, the vibrating cam is not mechanically linked with the polishing plate. Therefore, it is possible to provide a suction tool which is free from the danger that the fingers might be drawn into the gap between the polishing plate and the suction tool.

Finally, since the nineteenth configuration of the invention is constructed as described above, when the floor is dry polished without wax by the floor polisher attached to the suction port, it is possible to perform dry polishing while sucking hair, dust and the like from the flooring. Further, when the suction port comes in contact with the wall, it exhibits a maximum suction effect.

DESCRIPTION OF THE PREFERRED EMBODIMENTS

First Embodiment

Figure 3:
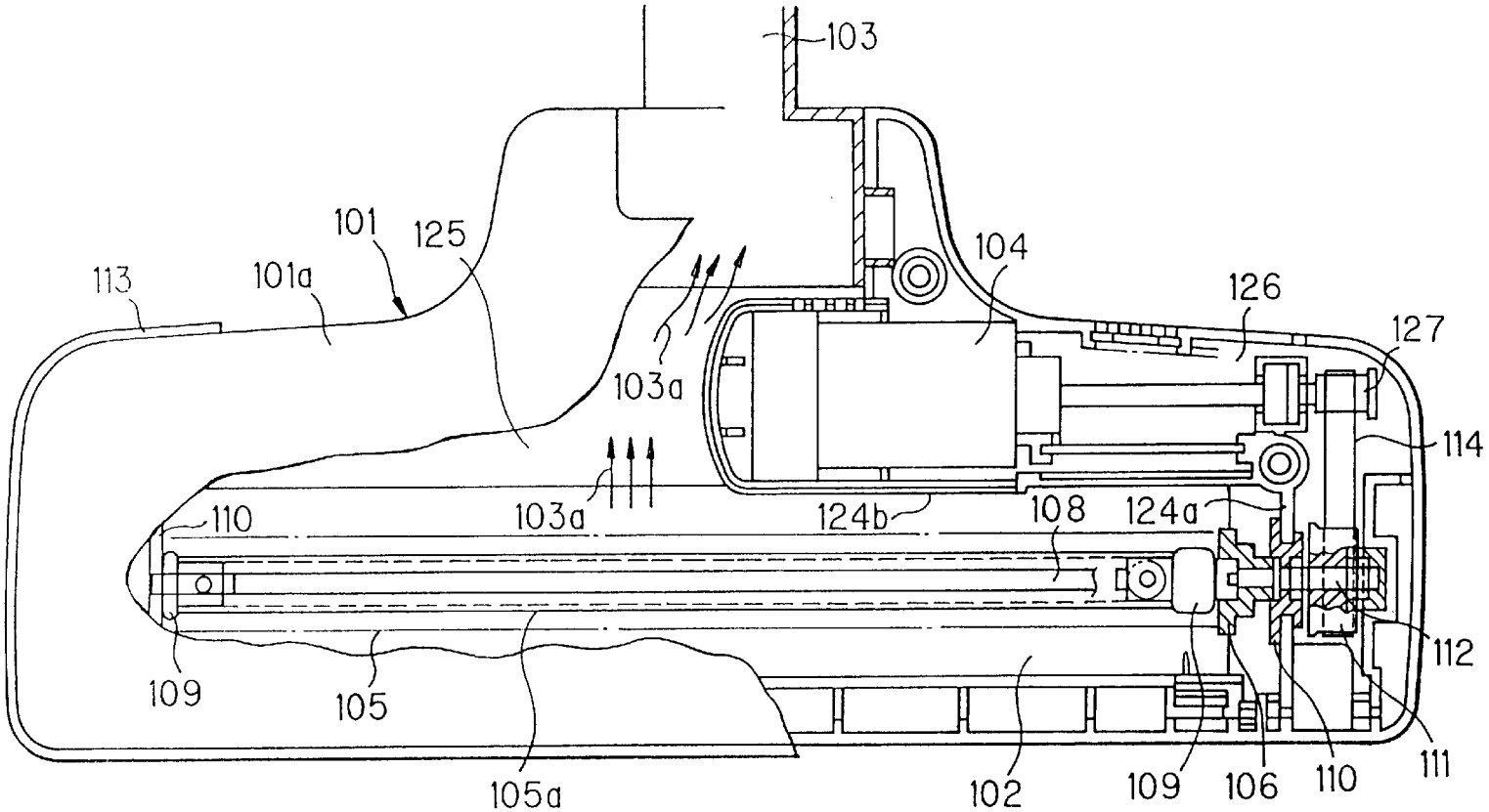
FIG. 3 is a partially cutaway plan view showing a suction tool of the first embodiment.
Figure 4:
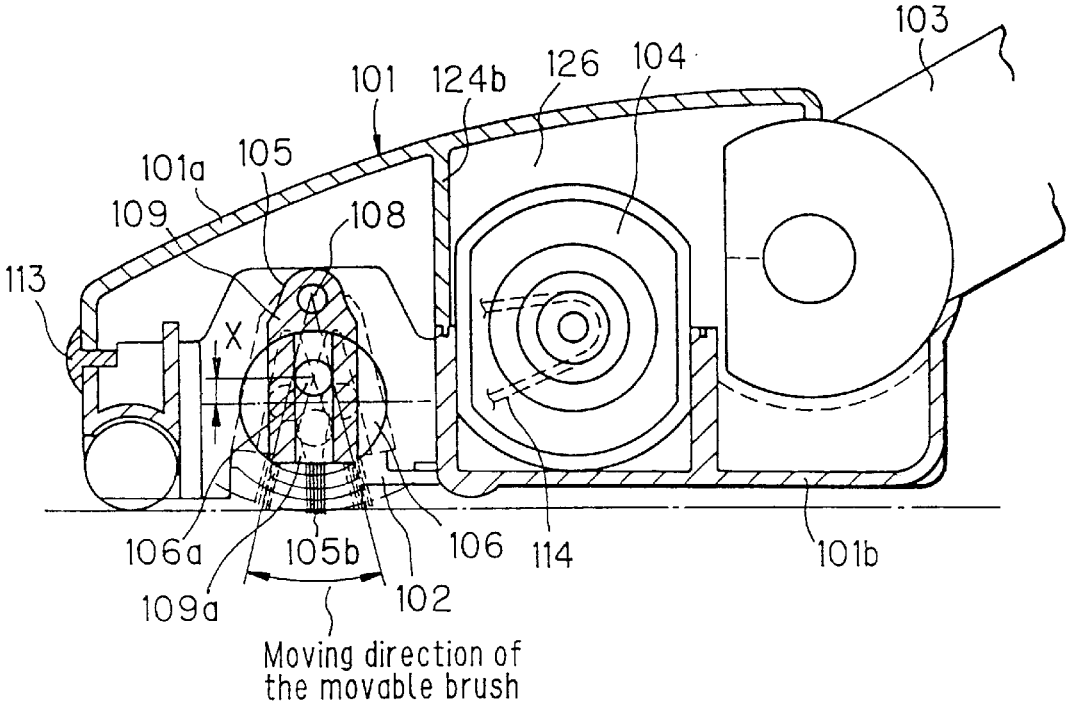
FIG. 4 is a vertical sectional side view showing essential parts of a suction tool of the first embodiment.
Figure 5:
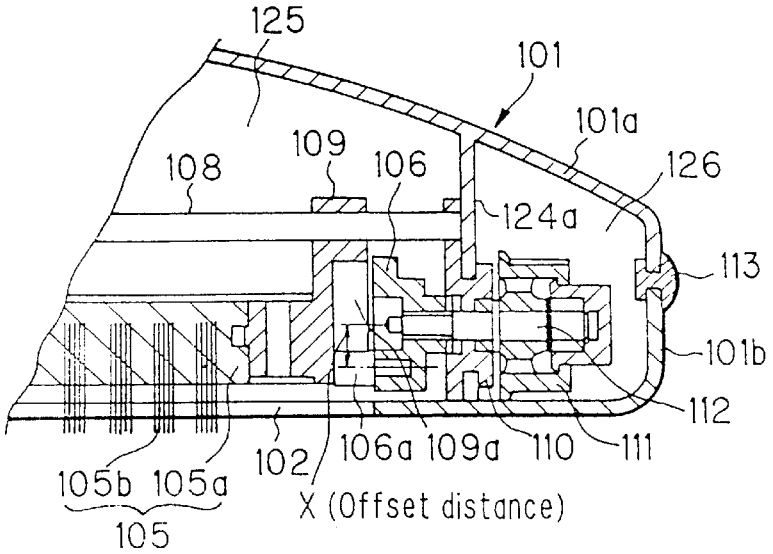
FIG. 5 is a vertical sectional front view showing essential parts of a suction tool of the first embodiment.

FIGS. 3 through 5 show the first embodiment of the invention; FIG. 3 is a partially cutaway plan view showing a suction tool for an electric vacuum cleaner; FIG. 4 is a vertical sectional side view showing the essential parts thereof; and FIG. 5 is a vertical sectional front view showing the essential parts thereof.

In each figure, 101 designates a suction tool body in which upper and lower casings 101*a* and 101*b* abut each other with a bumper 113 in between. Attached to the rear opening which is located between butted surfaces of upper and lower casings 101*a* and 101*b* is a suction pipe 103. Suction tool body 101 and a vacuum cleaner body (not shown) are connected by this suction pipe 103 and an unillustrated hose. Lower casing 101*b* has an elongated left to right lateral suction port 102 opening on its bottom face. The interior enclosed by upper and lower casings 101*a* and 101*b* is partitioned by partitioning walls 124*a* and 124*b* into a suction inflow passage 125 for conducting suction air stream 103*a* from suction port 102 to suction pipe 103, and a power transmission room 126.

Inside suction tool body 101, a motor 104 is assembled in power transmission room 126 and a movable brush 105 which is driven by motor 104 is incorporated in suction inflow passage 125 above suction port 102. Movable brush 105 is composed of an elongated left to right lateral base 105*a* and a number of bristles 105*b* embedded in the undersurface of the base, and is assembled so that the bristles 105*b* face suction port 102. A support shaft 108 is provided above movable brush 105 and is laterally supported in parallel with movable brush 105, by a pair of bearings 110, 110 which are disposed at the left and right ends. Bearings 110 are fitted and fixed to partitioning wall 124*a*. A pair of support plates 109 are integrally fastened at both, the left and right ends of base 105*a* of movable brush 105. The upper end portions of the left and right support plates 109 fit on, and are supported by, support shaft 108 so that the brush can freely sway back and forth. A rotatable shaft 112 in parallel with support shaft 108 is fitted and supported at the lower portion of bearing 110, having a pulley 111 fixedly attached at the end facing power transmission room 126. A belt 114 is wound between this pulley 111 and another pulley 127 on the shaft of motor 104. Shaft 112 has a rotary piece 106 at the other end thereof facing suction inflow passage 125. This rotary piece is fixedly attached so as to proximally face the outer end face of support plate 109. In this way, the rotation of motor 104 is transmitted via pulley 127, belt 114, pulley 111 and shaft 112 to rotary piece 106.

Rotary piece 106 has an offset pin 106*a* projecting from the end face thereof facing the outer surface of support plate 109, at a position set by a distance 'x' off the rotary axis thereof, while support plate 109 has a linear cam slot 109*a* which extends vertically, on the outer end face thereof so that the front end of offset pin 106 is slidably engaged into cam slot 109. As a result, when offset pip 106*a* is rotated, it reciprocates inside cam slot 109*a* so that support plate 109 sways back and forth about support shaft 108 in the direction perpendicular to the inflow direction of suction air stream 103*a*, and therefore movable brush 105 integrated with support plate 109 moves back and forth in the same direction.

In the above arrangement, when the vacuum cleaner body (not shown) is activated, dirt and dust is sucked together with the suction air stream from suction port 102 of suction tool 101, and is conducted to the dust collecting chamber in the vacuum cleaner body through suction inflow passage 125, suction pipe 103 and the hose (not shown). At this moment, movable brush 105 sways and reciprocates back and forth about support shaft 108 by the operation of motor 104, scrubbing dirt and dust which had settled on the floor surface, so that the thus scrubbed dust and dirt is sucked together with the suction air inflow. In this operation, movable brush 105 which sways back and forth about rotary shaft 108 needs less space as compared to the rotational space that was occupied by the conventional rotary brush 40 shown in FIGS. 1 and 2. Accordingly, it is possible to make suction tool body 101 compact proportionally. Further, this configuration, unlike rotary brush 40, has no risk that the fingers might be drawn into the tool, thus ensuring safer handling. In this case, in the limited narrow space inside suction tool body 101, it is possible to reliably and simply change the rotation of motor 104 into the oscillatory motion of movable brush 105 in the back and forth direction, by the combination of offset pin 106*a* of rotary piece 106 and support plate 109 having cam slot 109*a* engaged with this offset pin 106*a*. However, other mechanisms can also be used to change the rotation of motor 104 into the oscillatory motion of movable brush 105.

Second Embodiment

Figure 6:
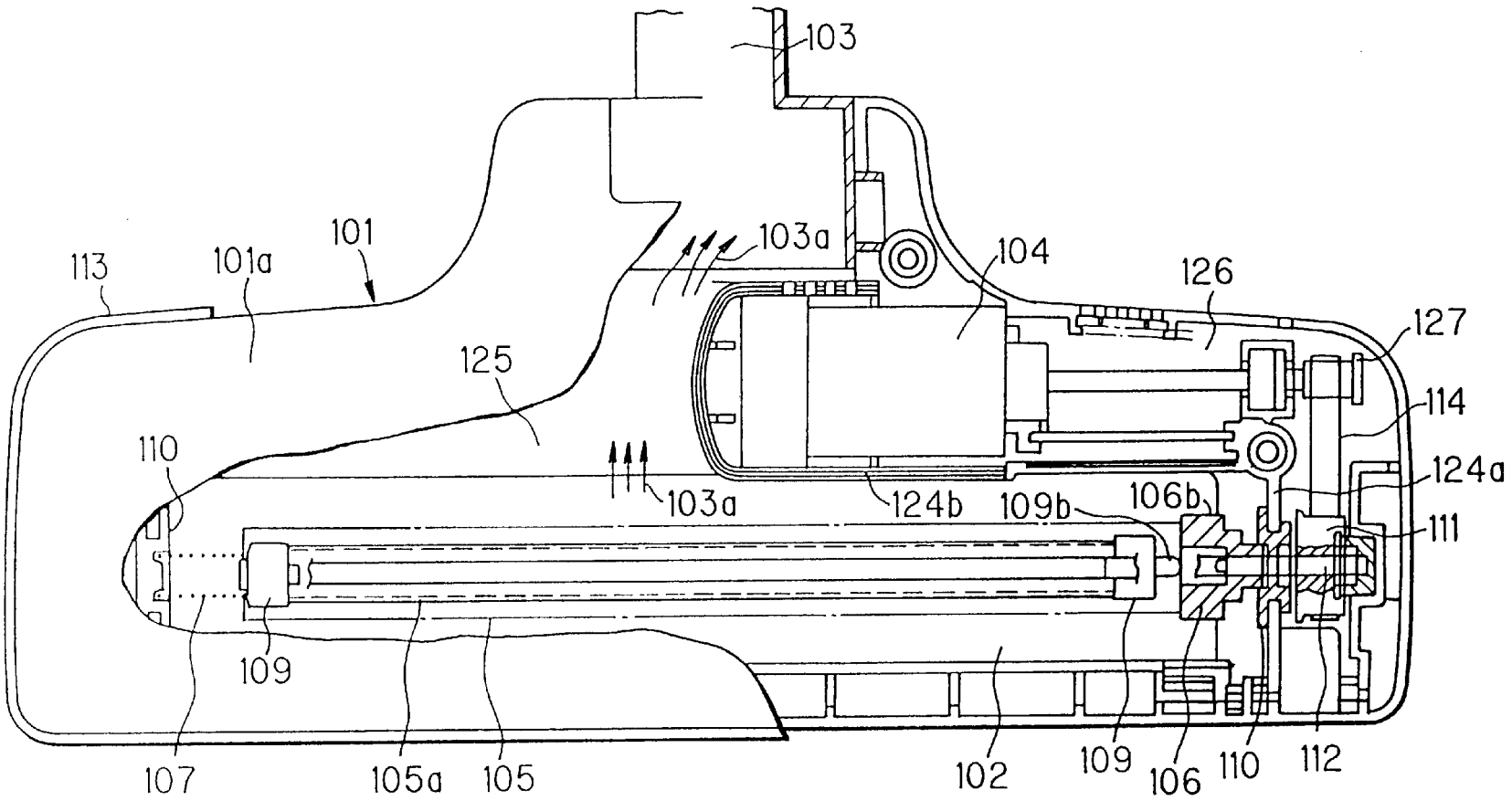
FIG. 6 is a partially cutaway plan view showing a suction tool of the second embodiment.
Figure 7:
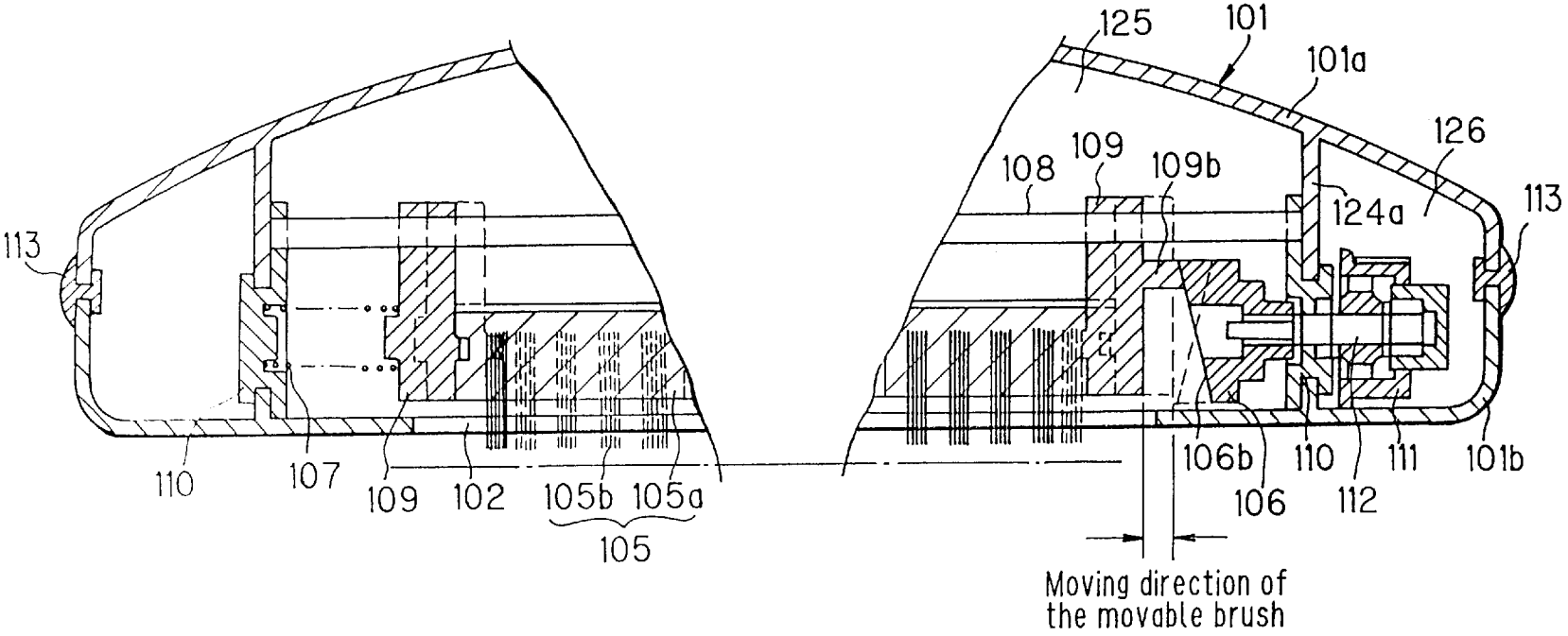
FIG. 7 is a vertical sectional front view showing essential parts of a suction tool of the second embodiment.

FIGS. 6 and 7 show the second embodiment of the invention. In this embodiment, a pair of support plates 109 are integrally fastened at the left and right ends of a movable brush 105, and their upper end portions fit on a support shaft 108 so that the support plates can move in the lateral direction along support shaft 108. A rotary piece 106 has a slanted cam surface 106*b* on the end face thereof facing the outer end face of one support plate 109, while a projection 109*b* is formed from the outer end surface of support plate 109 and the front end of projection 109*b* is abutted against slanted cam surface 106*b*. An elastic member 107 such as a coil spring, etc., is interposed between the other support plate 109 and a bearing 110 opposite it so as to constantly urge movable brush 105 toward the rotary piece 106 side. Thus, the abutment between the front end of projection 109*b* and slanted cam surface 106*b* is maintained. Accordingly, during one rotation of rotary piece 106, movable brush 105 linearly reciprocates along support shaft 108 in the left and right directions perpendicular to the inflow direction of the suction air stream 103*a* by the differential distance between the top and bottom of slanted cam surface 106*b*. The other configurations are the same as in the first embodiment.

In this embodiment, since movable brush 105 linearly reciprocates in the left and right directions, therefore, as in the case of the first embodiment, this configuration needs less space of motion as compared to the rotational space that was occupied by the conventional rotary brush 40. Accordingly, it is possible to make suction tool body 101 compact proportionally. Further, this configuration, unlike rotary brush 40, has no risk that the fingers might be drawn into the tool, thus ensuring safer handling. In this case, in the limited narrow space inside suction tool body 101, it is possible to definitely and simply change the rotation of motor 104 into the linear motion of movable brush 105, by the combination of slanted cam surface 106*b* of rotary piece 106 and support plate 109 having projection 109*b* abutted against this slanted cam surface 106*b*. However, other mechanisms can also be used to change the rotation of motor 104 into the linear motion of movable brush 105.

Third Embodiment

Figure 8:
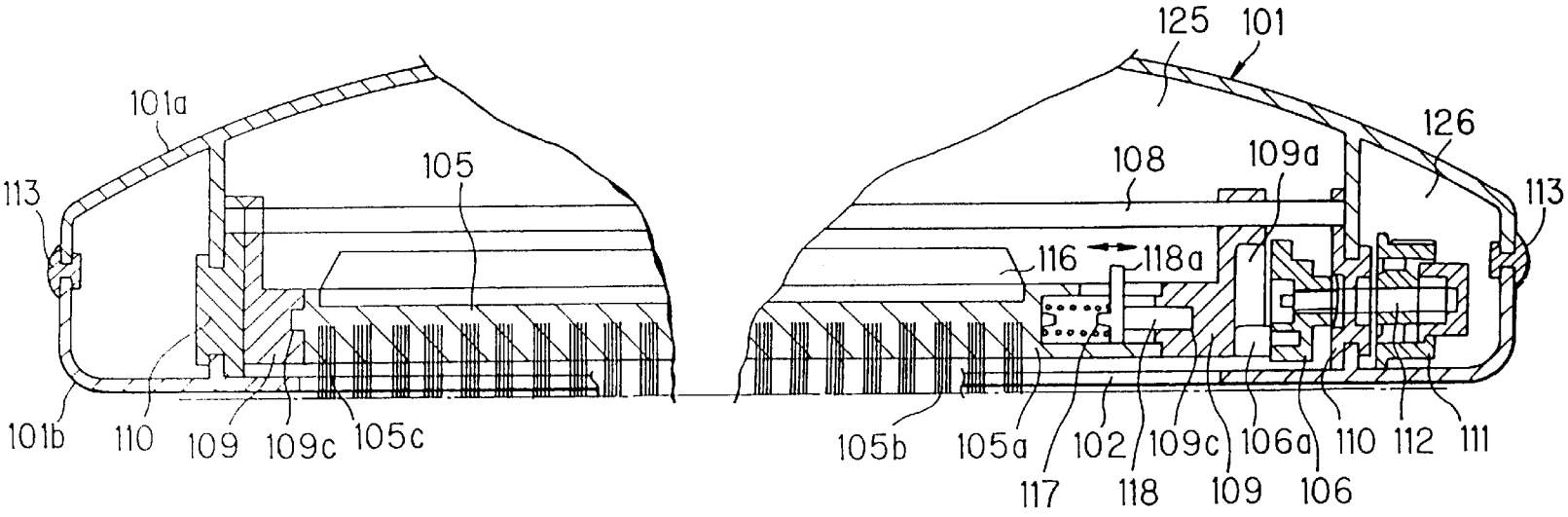
FIG. 8 is a vertical sectional front view showing essential parts of a suction tool of the third embodiment.
Figure 9:
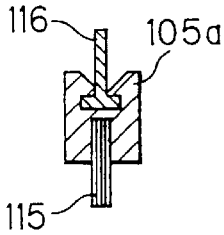
FIG. 9 is a sectional view showing a movable brush of the third embodiment.

FIGS. 8 and 9 show the third embodiment of the invention. In this embodiment, a movable brush 105 has an elongated left to right lateral base 105*a:* a number of bristles 105*b* are embedded in one, either top or bottom, side of the base 105*a*; and a blade 116 is embedded on the other side. Movable brush 105 is detachably mounted to, and supported by, a pair of left and right support plates 109, 109. Specifically, a tie rod 118 with a lever 118*a* is provided at the power transmission side of base 105*a* of movable brush 105, with an elastic member 117 of a coil spring etc., interposed in between, so that the tie rod can move to the left or right. A socket 109*c* is provided on the end face of the support plate 109 facing the tie rod so that tie rod 118 can fit thereinto and be drawn out therefrom. Base 105*a* has a projection 105*c* at the other end; the front end of this projection 105*c* is detachably inserted into another socket 109*c* which is formed on the end face of the other support plate 109 facing the projection. Thus, movable brush 105 is connectedly supported between the left and right support plates 109, 109 by means of projection 105*c* and tie rod 118. When lever 118*a* is shifted so that tie rod 118 moves toward the center in the lateral direction against the elastic force of elastic member 117, the end of tie rod 118 is drawn out from socket 109*c*. So, movable brush 105 can be taken out from the position between left and right support plates 109 and 109. Other configurations, such as the mechanism for activating motor 104 to cause movable brush 105 to sway and reciprocate back and forth about support shaft 108, and the like, are the same as those in the first embodiment.

In accordance with this embodiment, depending upon the type of the material on the floor, such as tatami mat (straw matting), carpet, rug, etc., either brush bristles 105*b* or blade 116 can be selectively used for convenience by detaching the movable brush 105 and reversing it upside down relative to the left and right support plates 109, 109.

In this connection, this movable brush 105 of the above embodiment can also be applied to the second embodiment where movable brush 105 reciprocates left and right along the support shaft 108.

Fourth Embodiment

Figure 10:
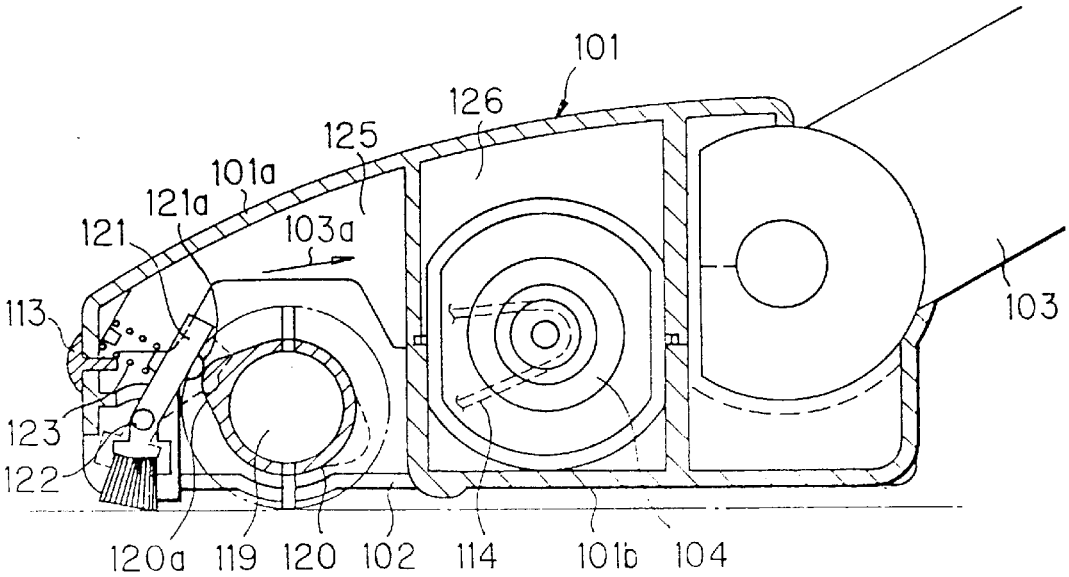
FIG. 10 is a vertical sectional front view showing essential parts of a suction tool of the fourth embodiment.

FIG. 10 shows the fourth embodiment of the invention. In this embodiment, a rotary brush 119 which is driven by a motor 104 is mounted inside a suction tool body 101, and a second brush 121 is provided in parallel to, and in front of, rotary brush 119. Second brush 121 is supported on a support shaft 122 provided in front of, and in parallel to rotary brush 119 so that it can sway back and forth. Fixed at one of the ends of rotary brush 119 with respect to the lateral direction is a cam 120 having a projection 120*a* on part of the peripheral side. Second brush 121 has an upward-extending portion above support shaft 122. This portion has a projection 121*a,* against which the peripheral side of cam 120 is abutted. Further, an elastic member 123 of a coil spring etc., is interposed between the upper-extending portion of second brush 121 and upper casing 101*a* so that the elastic force from elastic member 123 constantly presses and urges the upper-extending portion of second brush 121 toward rotary brush 119, thus abutting the end of projection 121*a* against the peripheral surface of cam 120. Accordingly, during one revolution of rotary brush 119, second brush 121 oscillationally swings back and forth about support shaft 122 due to the variation of the height of cam 120 because of projection 120*a*. Other configurations are the same as those in the first embodiment.

Figure 1:
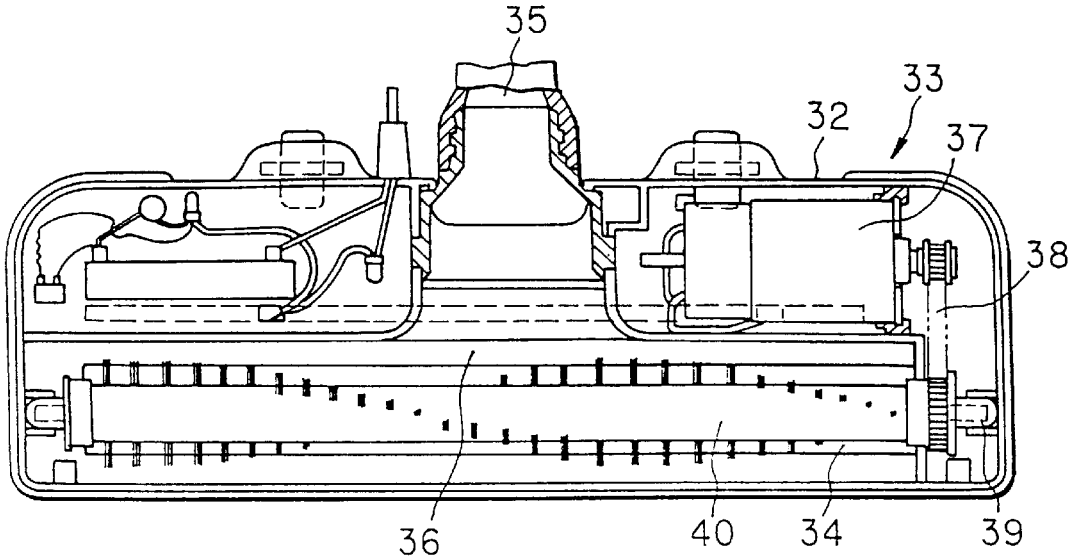
FIG. 1 PRIOR ART
FIG. 1 is a top sectional view showing the interior of a conventional suction tool.
Figure 2:
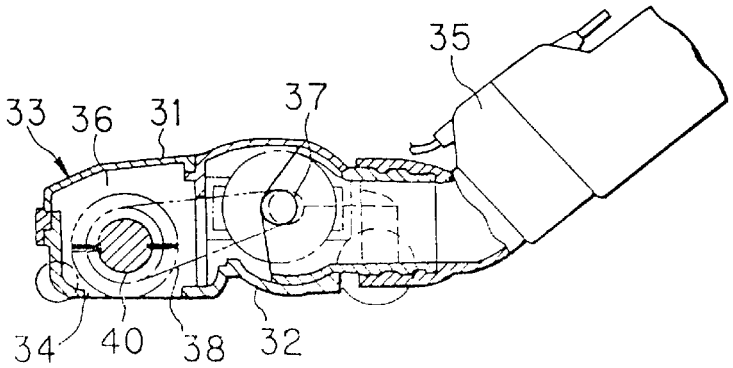
FIG. 2 PRIOR ART
FIG. 2 is a side sectional view showing the interior of a conventional suction tool.

It was impossible for the conventional rotary brush 40 shown in FIGS. 1 and 2 to collect the dust and dirt which had settled on the floor surface in front of the brush. In contrast, in accordance with this embodiment, dust and dirt located in front of rotary brush 119 can be scrubbed by second brush 121, thus improving the dust collecting efficiency. Further, motor 104 for driving rotary brush 119 can also be used to drive the second brush 121. In this case, in the limited narrow space inside suction tool body 101, it is possible to definitely and simply transmit the rotation of rotary brush 119 to the oscillatory motion of second brush 121 in the back and forth direction, by the combination of cam 120 and projection 121*a* which abuts cam 120. However, other mechanisms can also be used to change the rotation of rotary brush 119 into the oscillatory motion of second brush 121.

Fifth Embodiment

Figure 11:
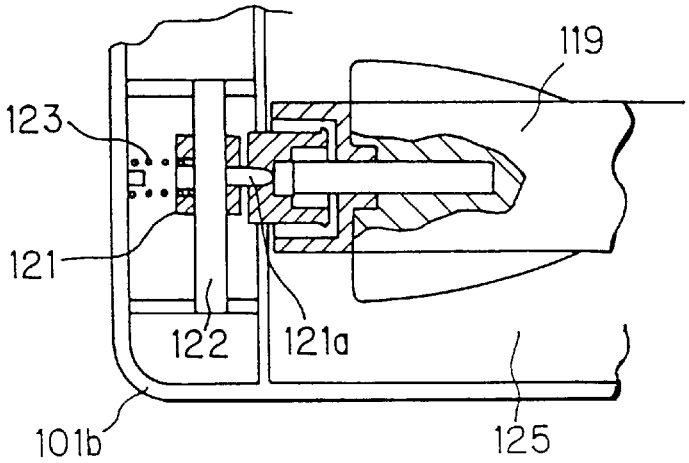
FIG. 11 is plan view showing essential parts of a suction tool of the fifth embodiment.
Figure 12:
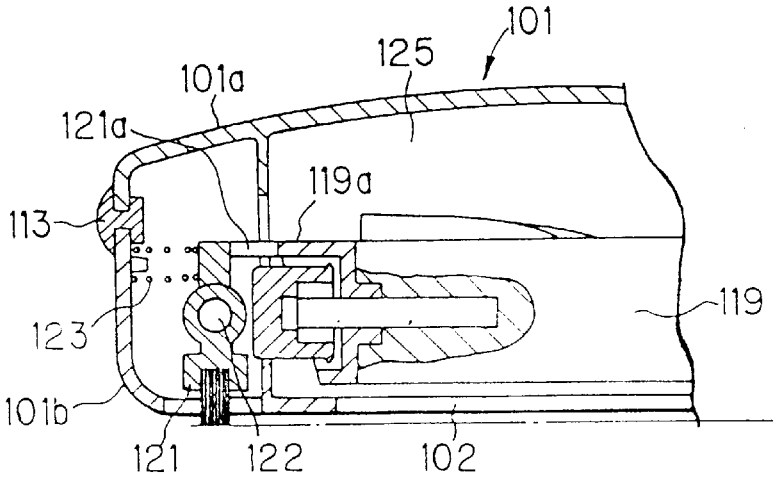
FIG. 12 is a vertical sectional front view showing essential parts of a suction tool of the fifth embodiment.

FIGS. 11 and 12 show the fifth embodiment of the invention. In this embodiment, a rotary brush 119 which is driven by a motor 104 is mounted inside a suction tool body 101, and a second brush 121 is provided at the left or right side of rotary brush 119. A support shaft 122 for the second brush is arranged perpendicular to rotary brush 119 on the left or right side thereof. The second brush 121 fits on, and is supported by, support shaft 122 so that it can swing left and right about the shaft 122. A slanted cam surface 119*a* is provided at the left or right end of rotary. brush 119. Second brush 121 has an upward-extending portion above support shaft 122 of second brush 121. This portion has a projection 121*a,* which abuts slanted cam surface 119*a*. Further, an elastic member 123 of a coil spring etc., is interposed between the upper-extending portion of second brush 121 and lower casing 101*b* so that the elastic force from elastic member 123 constantly presses and urges the upper-extending portion of second brush 121 toward rotary brush 119, thus abutting the end of projection 121*a* against the slanted cam surface 119*a*. Accordingly, during one revolution of rotary brush 119, second brush 121 sways and reciprocates left and right about support shaft 122 by the differential distance between the top and bottom of slanted cam surface 119*a*. Other configurations are the same as in the first embodiment.

It was impossible for the conventional rotary brush 40 shown in FIGS. 1 and 2 to collect the dust and dirt which had settled on the floor surface at the side of the brush. In contrast, in accordance with this embodiment, dust and dirt located at the side of rotary brush 119 can be scrubbed by second brush 121, thus improving the dust collecting efficiency. Further, motor 104 for driving rotary brush 119 can also be used to drive the second brush 121. In this case, in the limited narrow space inside suction tool body 101, it is possible to definitely and simply change the rotation of rotary brush 119 into the left to right oscillatory motion of second brush 121, by the combination of slanted cam surface 119*a* and projection 121*a* which abuts the slanted cam surface 119*a*. However, other mechanisms can also be used to change the rotation of rotary brush 119 into the oscillatory motion of second brush 121.

Sixth Embodiment

Figure 13:
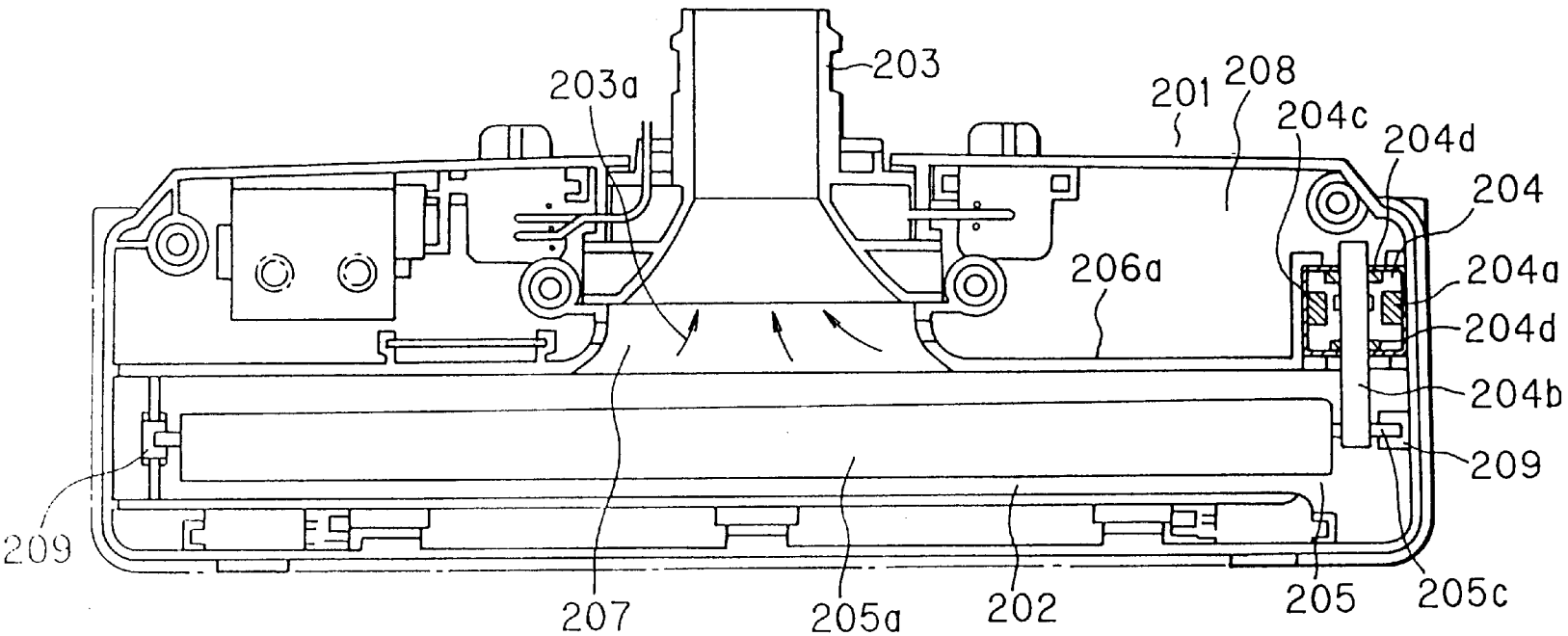
FIG. 13 is a top sectional view of a suction tool for an electric vacuum cleaner in accordance with the sixth embodiment of the invention.
Figure 14:
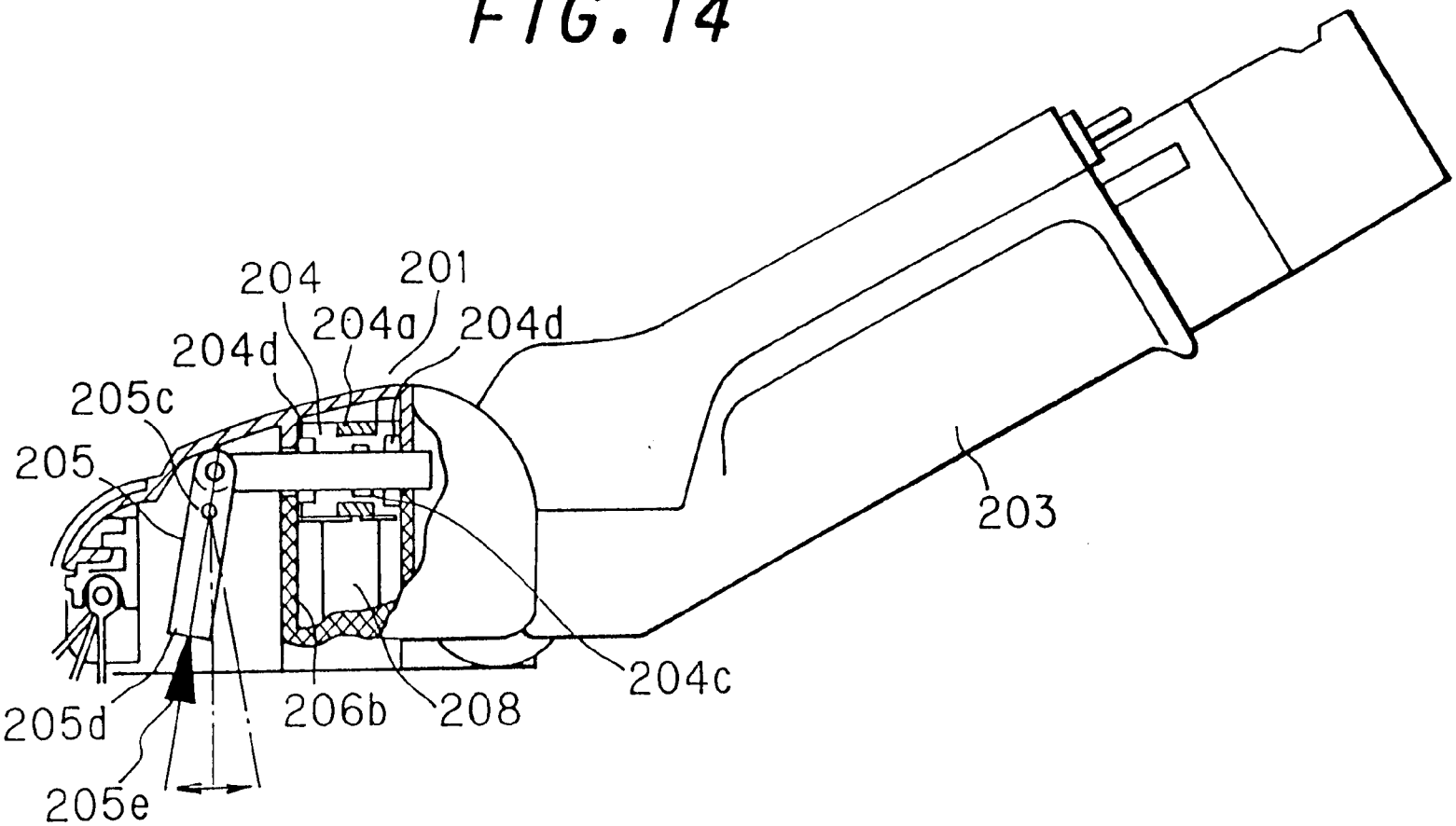
FIG. 14 is a sectional side view of a suction tool for an electric vacuum cleaner in accordance with the sixth embodiment of the invention.

FIGS. 13 and 14 show the sixth embodiment of the invention; FIG. 13 is a sectional top view showing a suction tool for an electric vacuum cleaner; and FIG. 14 is a sectional side view of it. In these figures, 201 designates a suction tool body. Attached to the rear opening of the body is a suction pipe 203. Suction tool body 201 and a vacuum cleaner body (not shown) are connected by this suction pipe 203 and an unillustrated hose. The suction tool body 201 has an elongated left to right lateral suction port 202 opening on its bottom face. The interior enclosed is partitioned by partitioning walls 206*a* and 206*b* into a suction inflow passage 207 for conducting suction air stream 203*a* from suction port 202 to suction pipe 203, and a power transmission room 208. Inside suction tool body 201, a driver device 204 is provided in power transmission room 208, and a movable brush unit 205 which is driven by driver device 204 is incorporated in suction inflow passage 207 above suction port 202.

Figure 15:
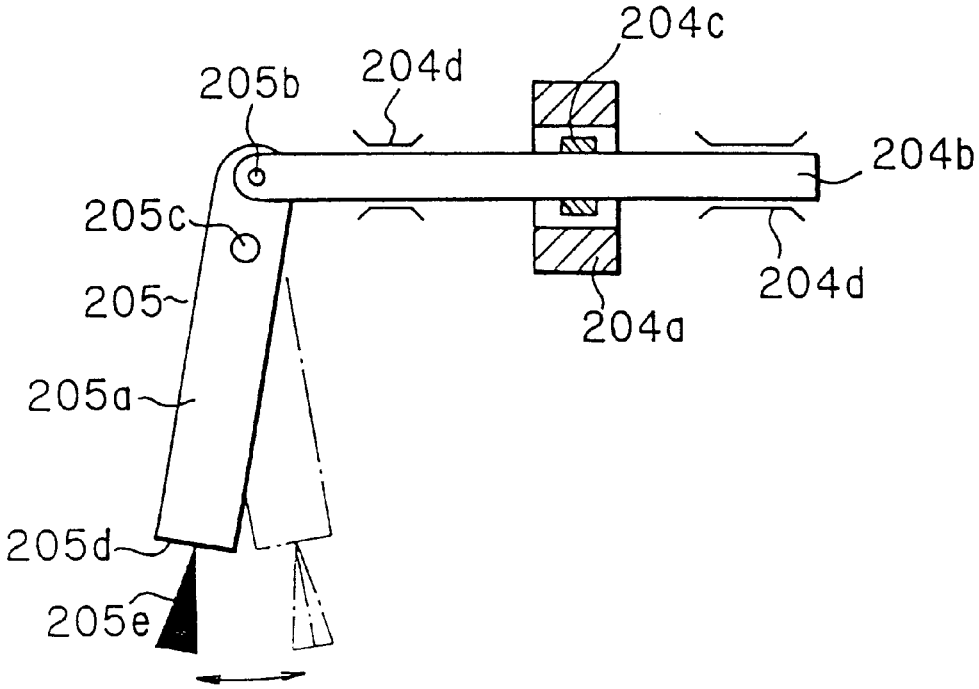
FIG. 15 is an overall view showing a driver mechanism and a movable brush unit in a suction tool for an electric vacuum cleaner of the sixth embodiment of the invention.

The above driver device 204 is made up of a linear motor as schematically shown in FIG. 15, including: a coil 204*a* of a donut shape affixed on the wall surface of power transmission room 208; a rod 204*b* fitted through coil 204*a;* and an annular ferromagnetic body (a magnet) 204*c* which fits on rod 204*b* at a position corresponding to coil 204*a*.

Rod 204*b* is supported by thrust bearings 204*d* and 204*d* at both ends thereof. When coil 204*a* is supplied with an a.c. current, the rod reciprocates left and right in the drawing, due to the magnetic field generated with ferromagnetic body 204*c*.

In movable brush unit 205, 205*a* designates an oscillator plate made up of a rectangular sheet, and it has a pair of support shafts 205*c*, 205*c* projecting from the side faces at both ends. These shafts are supported by support plates 209, 209 affixed on the wall surfaces at both sides of suction tool body 201, so that the oscillator plate 205*a* is arranged in the lateral direction inside suction port 202. This oscillator plate 205*a* is linked with the front end of the aforementioned rod 204*b,* at a point above support shaft 205*c* with a linking pin 205*b,* so that the plate can sway and reciprocate about support shaft 205*c* following the reciprocating motion of rod 204*b*.

Seventh Embodiment

Figure 16:
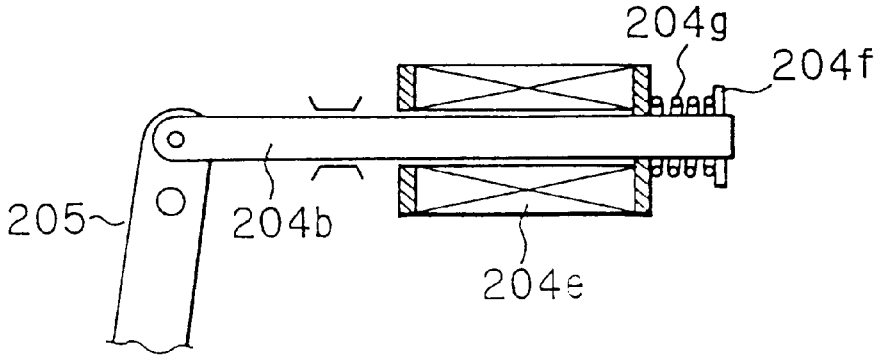
FIG. 16 is an overall view showing a driver mechanism in a suction tool for an electric vacuum cleaner of the seventh embodiment of the invention.

FIG. 16 is another variation of the above driver device 204. In this embodiment, a rod 204*b* is fitted through a solenoid 204*e*. This rod 204*b* is linked at its one end with the aforementioned oscillator plate 205*a*; the other side of the rod projecting out from solenoid 204*e* with a loose coil spring 204*g* interposed between solenoid 204*e* and a catch 204*f* fastened at the distal end of the rod.

In the configurations of the sixth and seventh embodiments, when the vacuum cleaner body (not shown) is activated, dirt and dust is sucked together with the suction air stream from suction port 202 of suction tool 201, and is conducted to the dust collecting chamber in the vacuum, cleaner body through suction inflow passage 207, suction pipe 203 and the hose (not shown).

As soon as the vacuum cleaner is activated, coil 204*a* of the linear motor in the sixth embodiment is supplied with a.c. current, rod 204*b* slides back and forth to oscillationally drive crank (oscillator plate) 205*a*, thus a movable brush 205*e* scrubs dust and dirt which had settled on the floor surface. The dirt and dust scrubbed are sucked together with the aforementioned suction air stream.

In the case where driver device 204 is in the form of the seventh embodiment shown in FIG. 16, when solenoid 204*e* is intermittently energized, rod 204*b* moves back and forth with the help of the elastic force of coil spring 204*g,* thus movable brush 205*e* can scrub dust and dirt which had settled on the floor surface.

Figure 17:
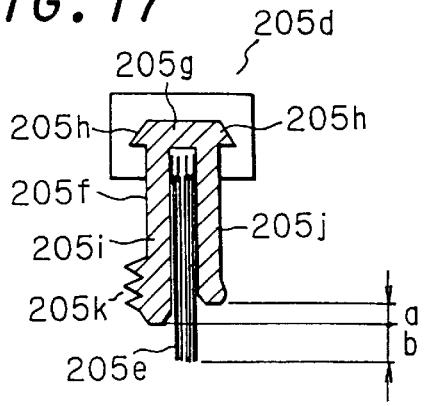
FIG. 17 is an overall sectional side view showing a movable brush unit in a suction tool for an electric vacuum cleaner of the eighth embodiment of the invention.
Figure 18:
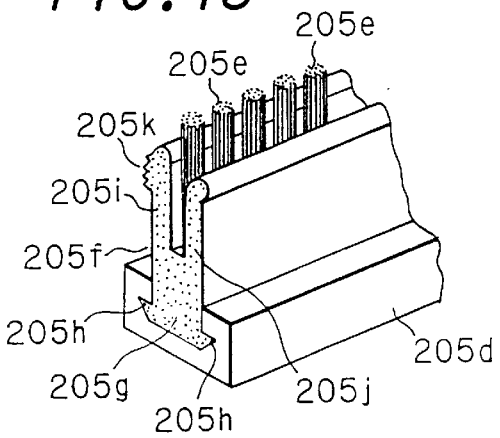
FIG. 18 is an overall perspective view showing essential components of a movable brush unit in a suction tool for an electric vacuum cleaner of the eighth embodiment of the invention.

In the above way, movable brush 205*e* which sways back and forth needs less space as compared to the rotational space that was occupied by the conventional rotary brush 40 shown in FIG. 1. Accordingly, it is possible to make suction tool body 201 compact proportionally. Further, this configuration, unlike rotary brush 40, has no risk that the fingers might be drawn into the tool, thus ensuring safer handling. Moreover, conventional vacuum cleaners needed a lot of parts such as pulleys, belts etc., for transmitting the rotation of motor 37 to the rotary brush in order to operate rotary brush 40. In contrast, the structure of the invention, needs fewer parts to perform the same operation. Eighth embodiment Next, another embodiment of movable brush unit 205 will be described. In FIGS. 17 and 18, a base 205*d* has a sweeping member 205*f* fitted to and fixed on the undersurface thereof. Sweeping member 205*f* is a molding of rubber, including a base part 205*g* having engaging ribs 205*h,* 205*h* extending along the length of the upper side thereof, and sweeping parts 205*i* and 205*j* which extend downward on both the front and rear side from the underside thereof.

Base part 205*g* has a movable brush 205*e* in which bristle bundles are planted at regular intervals along the length.

Front sweeping part 205*i* has sweeper ribs 205*k* formed entirely across the front-side surface at the end portion thereof. In this embodiment, as apparent from the drawings, the dimensions of front and rear sweeping parts 205*i*, 205*j*, and the bristle bundle of movable brush 205*e* can be seen: front sweeping part 205*i* is set longer by 'a' than part 205*j*; and the bristle bundle of movable brush 205*e* is set longer by 'b' than part 205*i*. The former dimensional difference 'a' contributes to the improvement in scrubbing efficiency of lint and fluff, while the latter dimensional difference 'b' contributes to the prevention of damage to the floor surface when the floor is made up of flooring.

Ninth Embodiment

Figure 19:
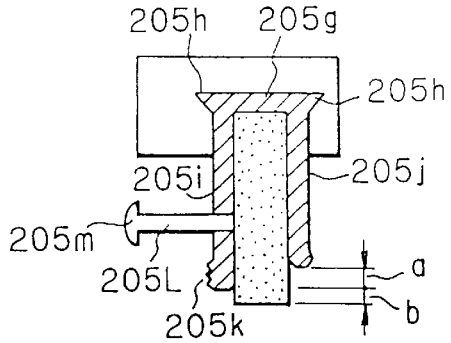
FIG. 19 is an overall sectional side view showing a moving unit in a suction tool for an electric vacuum cleaner of the ninth embodiment of the invention.

FIG. 19 is a further embodiment of movable brush unit 205. In the embodiment shown in FIG. 17, movable brush 205*e* is formed of bristles, but in this embodiment, it is made from a porous material such as sponge, felt etc. Further, in this case, elastic branches 205L which each have a hemispherical knob 205*m* at the tip thereof are arranged at regular intervals on the front side of front-side sweeping part 205*i*.

In the above configuration of movable brush unit 205, when the movable brush 205*e* of the eighth embodiment shown in FIG. 17 is used to clean the floor surface, only movable brush 205*e* comes in contact with the floor surface whilst movable brush 205*e* sways together with crank 205*a* moved by driver device 204. Therefore, the front and rear sweeping parts 205*i* and 205*j* will not damage the floor. When this unit is used for cleaning carpet etc., front sweeping part: 205*i* scrubs lint and fluff whilst the front sweeping part 205*i* sways, improving the cleaning efficiency.

When movable brush 205*e* of the ninth embodiment shown in FIG. 19 is used, hemispherical knobs 205*m* of elastic branches 205L can scrub dust and dirt from the carpet etc., in an efficient manner.

Tenth Embodiment

Figure 20:
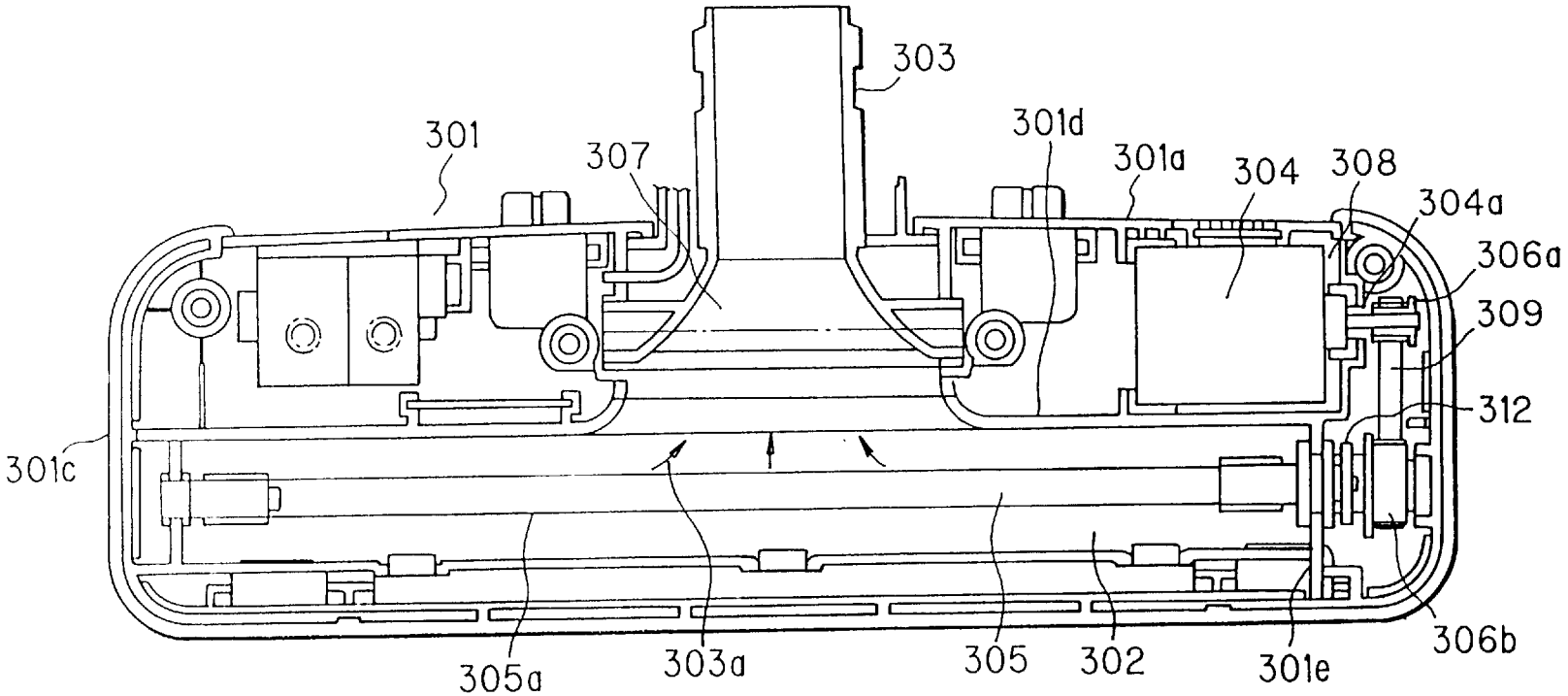
FIG. 20 is a top sectional view showing a suction tool for an electric vacuum cleaner in accordance with the tenth embodiment of the invention.
Figure 21:
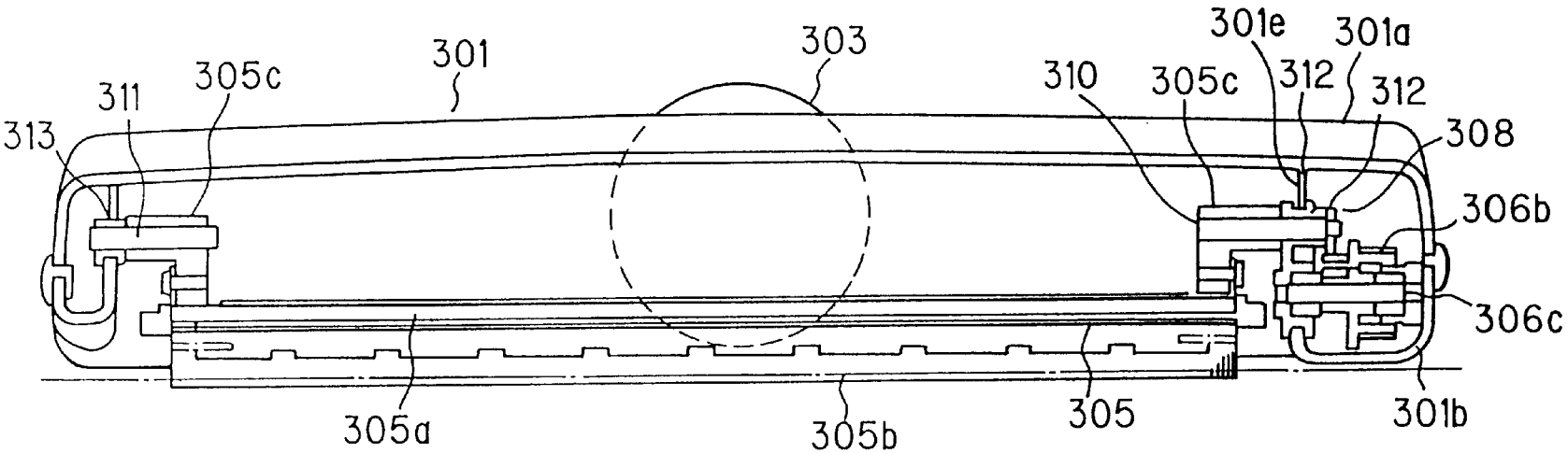
FIG. 21 is a sectional front view showing a suction tool for an electric vacuum cleaner in accordance with the tenth embodiment of the invention.
Figure 22:
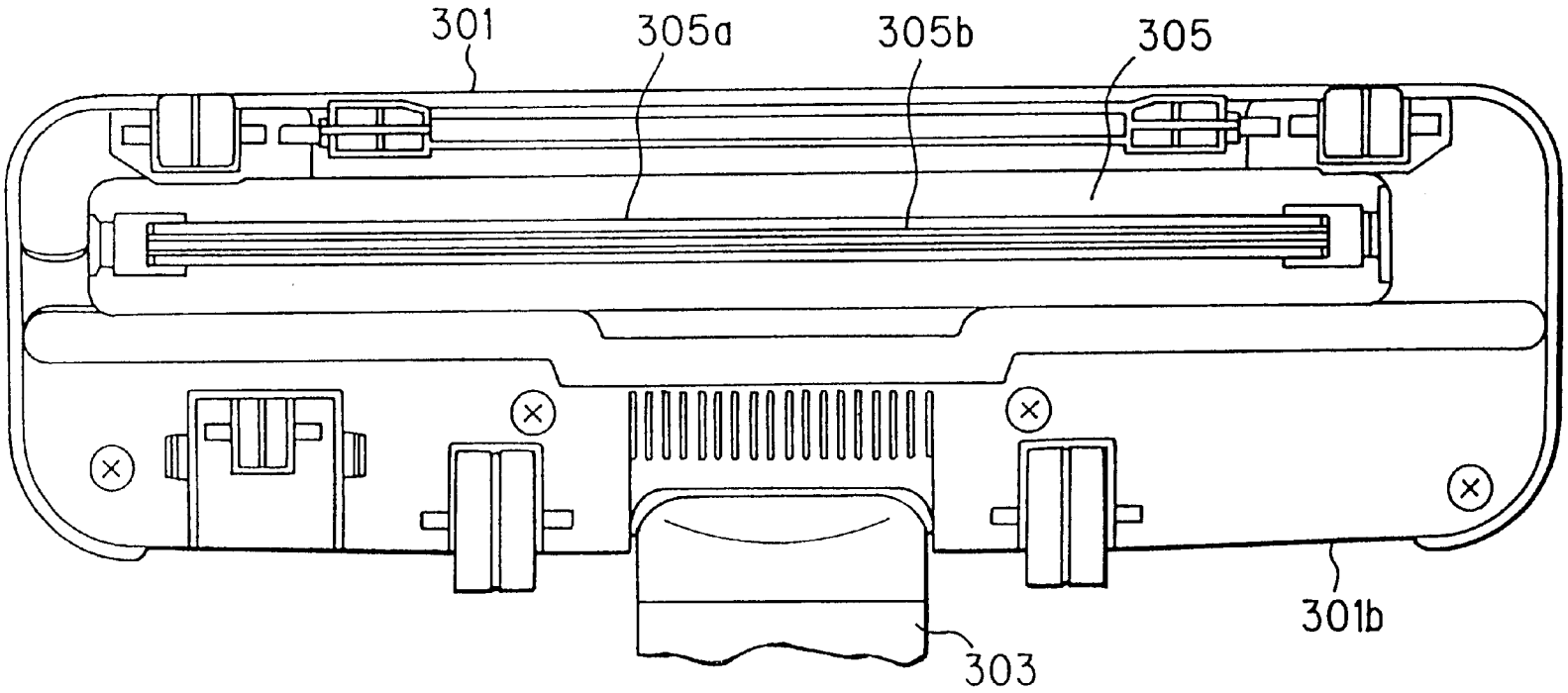
FIG. 22 is a bottom view showing a suction tool for an electric vacuum cleaner in accordance with the tenth embodiment of the invention.
Figure 23:
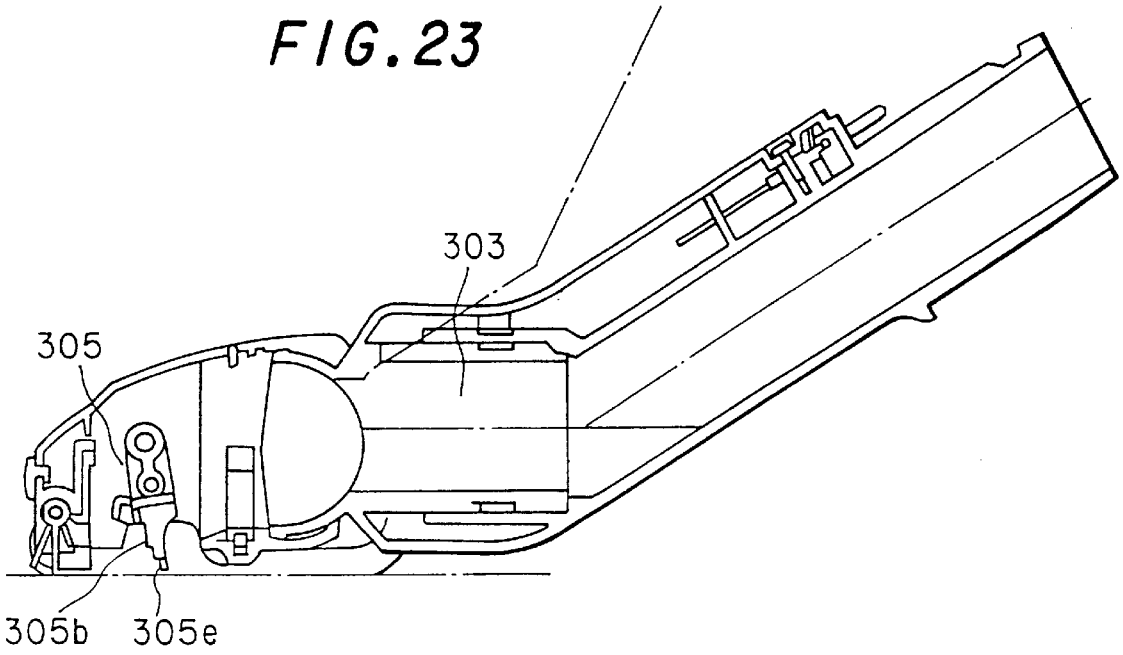
FIG. 23 is a sectional side view showing the central portion of a suction tool for an electric vacuum cleaner in accordance with the tenth embodiment of the invention.
Figure 24:
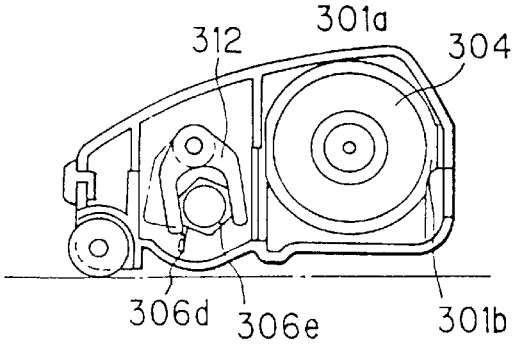
FIG. 24 is a sectional side view showing essential components of a suction tool for an electric vacuum cleaner in accordance with the tenth embodiment of the invention.

FIGS. 20, 21, 22 and 23 show a suction tool of the tenth embodiment of the invention: FIG. 20 is a top sectional view of the suction tool for an electric vacuum cleaner; FIG. 21 is its sectional front view; FIG. 22 is its bottom view; and FIG. 23 is its sectional side view. FIG. 24 is a sectional side view showing essential components thereof.

In these figures, 301 designates a suction tool body in which upper and lower casings 301*a* and 301*b* are integrally formed with a bumper 301*c* as a shock absorber in between. Attached to the rear opening of upper casing 301*a* is a suction pipe 303. Suction tool body 301 and a vacuum cleaner body (not shown) are connected by this suction pipe 303 and an unillustrated hose.

Suction tool body 301 has an elongated left to right lateral suction port 302 opening on its bottom face. The interior of the body is partitioned by partitioning walls 301*d* and 301*e* into a suction inflow passage 307 for conducting suction air stream 303*a* from suction port 302 to suction pipe 303, and a power transmission room 308. Inside suction tool body 301, a driver device 304 is provided in power transmission room 308, and a movable brush unit 305 which is operated by driver device 304 is arranged in suction port 302. The driver device 304 is made up of a motor or turbine, and a driver pulley 306*a* is attached to a rotary shaft 304*a*. A driven pulley, designated at 306*b*, is attached to a rotary shaft 306*c* which is set so as to rotate between partitioning wall 301*e* and lower casing 301*b*, and is adapted to be rotated through a belt 309. The above movable brush unit 305 is composed of a unit base frame 305*a* extending along the suction portion 302, and a movable-brush assembly 305*b*. Unit base frame 305*a* has arms 305*c*, 305*c* which are formed upright at both ends thereof and is formed with pivot shafts 310 and 311, respectively. These shafts 310 and 311 pivots on bearings 312 and 313 provided on the supporting walls inside upper casing 301*a*, so that the unit is able to sway back and forth inside suction port 302.

Figure 25:
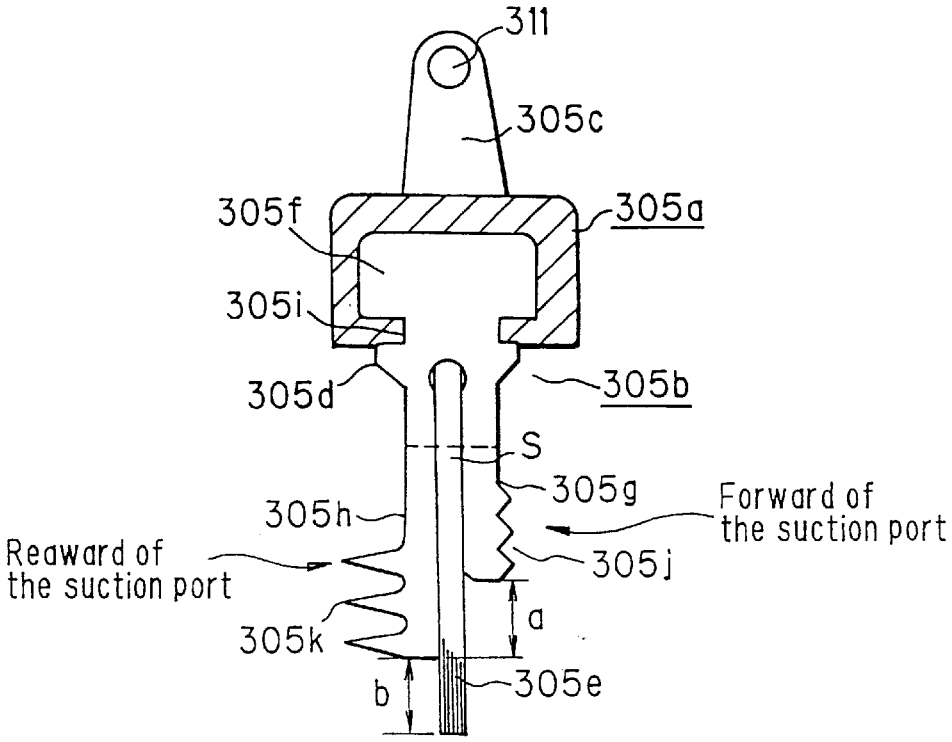
FIG. 25 is an overall sectional view showing essential components of a movable brush in a suction tool for an electric vacuum cleaner in accordance with the tenth embodiment of the invention.
Figure 26:
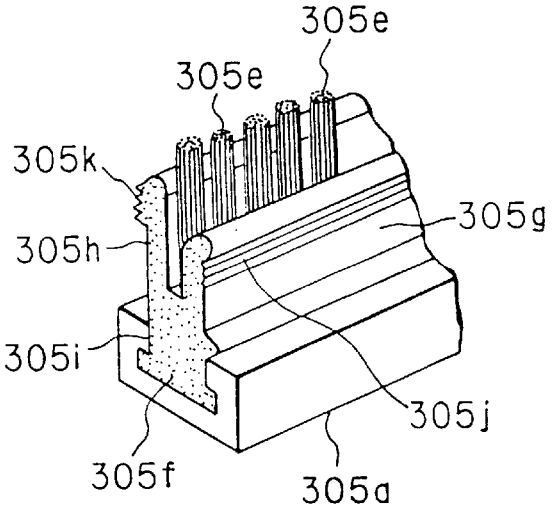
FIG. 26 is a perspective view showing essential components of a movable brush unit.

As shown in FIGS. 25 and 26, the aforementioned movable-brush assembly 305*b* is composed of a sweeping member 305*d* and movable brush 305*e* which is impregnated with liquid paraffin. Sweeping member 305*d* is a molding of rubber, including a base part 305*f* able to fit unit base frame 305*a*, and sweeping parts 305*g* and 305*h* which extend downward in parallel to one another with a gap S therebetween, on both, the front and rear side from the lower side of base part 305*f*. The lengths of sweeping parts 305*g* and 305*h* are made different. Further, engaging grooves 305*i* for engagement with base frame 305*a* are formed on the sides of base part 305*f*, along the length thereof.

The above front and rear sweeping parts 305*g* and 305*h* have sweeper ribs 305*j* and 305*k*, formed at their lower side faces. Embedded in the gap S between the sweeping parts are a number of bundles of bristles forming movable brush 305*e*, at regular intervals along the length. In this embodiment, as apparent from the drawings, the dimensions of front and rear sweeping parts 305*g*, 305*h*, and the bristle bundle of movable brush 305*e* can be seen: rear sweeping part 305*h* is set longer by 'a' than front sweeping part 305*g*; and the bristle bundle of movable brush 305*e* is set longer by 'b' than rear sweeping part 305*h*. The former dimensional difference 'a' contributes to the improvement in scrubbing efficiency of lint and fluff, while the latter dimensional difference 'b' contributes to the prevention of damage to the floor surface when the floor is made up of flooring.

Returning to FIGS. 20 to 24, in power transmission room 308, 312 designates an oscillator plate of an inverted U-shape. This oscillator plate is fixed to the front end of pivot shaft 310, and engages an offset link 306*e* affixed to an offset pin 306*d* provided on driven pulley 306*b*, so that the plate can oscillate in accordance with the rotation of offset link 306*e*.

In the arrangement described above, when the vacuum cleaner body is activated, dirt and dust is sucked together with the suction air stream 303*a* from suction port 302 of suction tool 301, and is conducted to the dust collecting chamber in the vacuum cleaner body through suction inflow passage 307, suction pipe 303 and the hose. At the same time, when driver device 304 is activated during the operation of the vacuum cleaner body, the driver force from driver device 304 is transmitted by way of driver pulley 306*a* and belt 309 to driven pulley 306*b*, whereby the rotation of pulley 306*b* is transmitted to oscillator plate 312 through offset pin 306*d* and link 306*e*.

As a result, oscillator plate 312 sways, and this oscillatory motion is transmitted to movable brush unit 305, thus the movable brush unit 305 sways back and forth, whereby movable brush 305*e* scrubs dust and dirt which had settled on the floor surface. The thus scrubbed dust and dirt is sucked together with suction air stream 308*a* into the vacuum cleaner body.

Eleventh Embodiment

Figure 27:
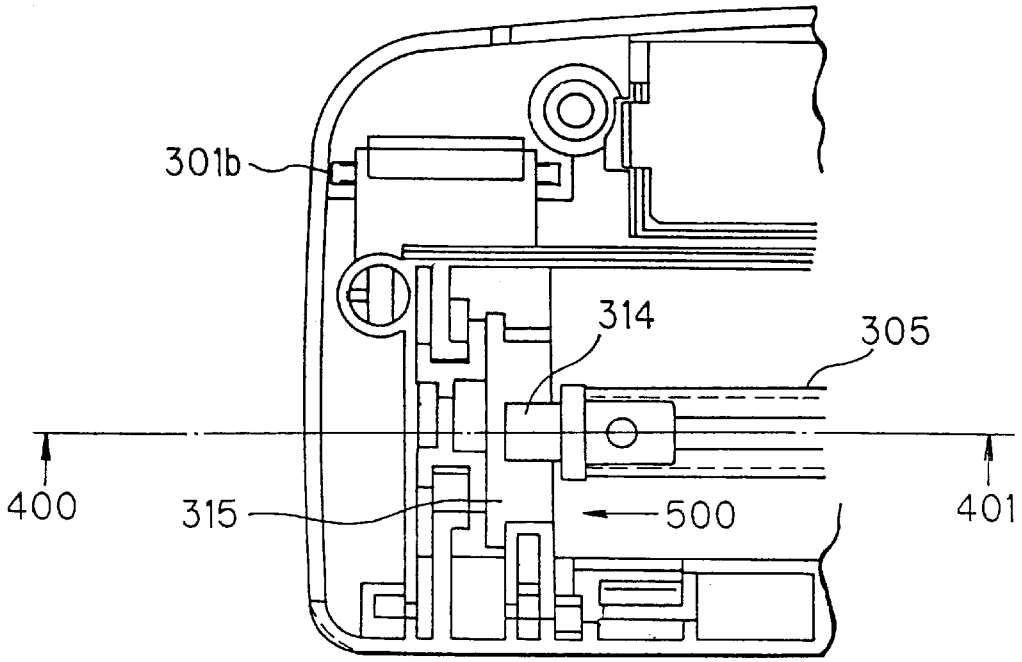
FIG. 27 is a top sectional view showing essential components of a suction tool for an electric vacuum cleaner in accordance with the eleventh embodiment of the invention.
Figure 28:
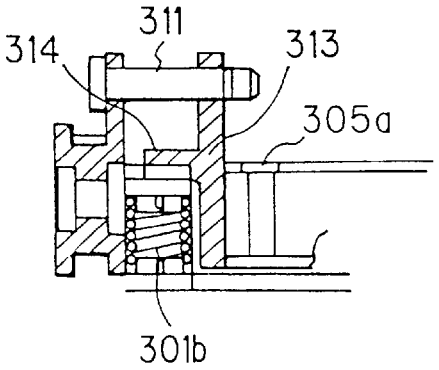
FIG. 28 is a sectional front view taken across a plane 400–401 in FIG. 27.
Figure 29:
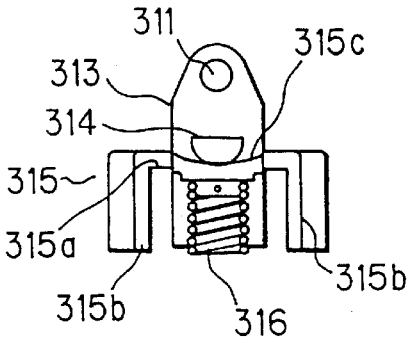
FIG. 29 is a view of the components of FIG. 27 in the direction shown by an arrow 500.

FIGS. 27 through 29 show an example of a mechanism for preventing vibration of the above movable brush unit 305. In this anti-vibration mechanism shown in these figures, in place of arm 305*c* of base unit 305*a*, arm plate 313 whose upper end is fixed to pivot shaft 311 is provided at the end of base unit 305*a*. An oscillatory cam 314 of a semi-circular shape is formed at half the height of arm plate 313, so that the arm plate is mounted on, and supported by, an anti-vibration plate 315 via the oscillatory cam.

This anti-vibration plate 315, as shown in FIG. 29, has a pair of legs 315*b*, 315*b*, which are connected to each other by a supporting plate 315*a* whose top surface constitutes a supporting surface 315*c* of an arc shape for the smooth sliding of the aforementioned oscillatory cam 314. Provided beneath supporting plate 315*a* is an anti-vibration coil 316. In this arrangement, when arm plate 313 swings together with movable brush unit 305, oscillatory cam 314 reciprocates along supporting surface 315*c*, while anti-vibration coil 316 prevents movable brush unit 305 from vibrating. The thus configured anti-vibration mechanism is provided for both ends of movable brush unit 305.

Twelfth Embodiment

Figure 30:
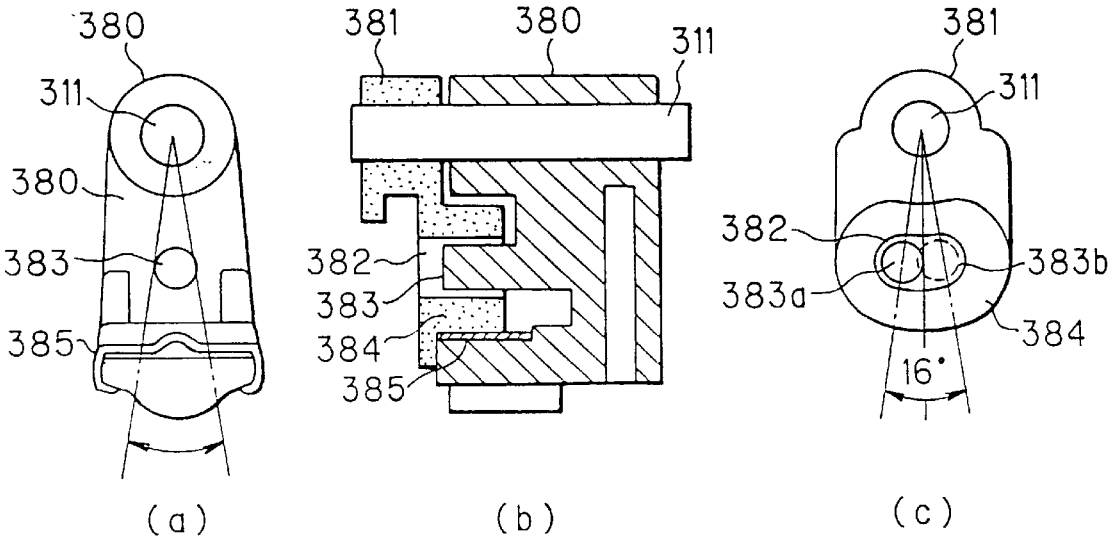
FIG. 30 is a structural view showing essential components of a suction tool for an electric vacuum cleaner in accordance with the twelfth embodiment of the invention.

Since the movable brush unit is driven by motor on only one side, this geometry inevitably causes the pivot shaft at the other side to vibrate (oscillate back and forth). FIG. 30 shows an embodiment in which an angular motion regulatory mechanism for regulating the aforementioned vibration. This angular motion regulatory mechanism is provided in place of the mechanism shown in FIGS. 28 and 29, for example.

In FIG. 30, a rotary arm (rotational member) 380 is fixed to pivot shaft 311 of the movable brush. Designated at 381 is a fixed arm (immovable member), which rotatably supports pivot shaft 311. This fixed arm 381 is fixed to lower casing 301*b*.

FIG. 30(*a*) is a view of rotary arm 380 from the left; and FIG. 30(*c*) is a view of fixed arm 381 from the right.

Fixed arm 381 has a through hole 382 of an elliptical section formed therein. A pin 383 of rotary arm 380 is inserted into this through hole 382. Accordingly, when pivot shaft 311 rotates, the rotation is limited to the range in which pin 383 can move within through hole 382. As a result, the rotation of pivot shaft 311 is regulated. In FIG. 30(*c*), pin 383 only moves between the position indicated by a solid line 383*a* and the position indicated by a broken line 383*b*, with an angular variation of about 16°.

Through hole 382 is formed by a pipe-like portion 384. This pipe-like portion 384 is arranged so that a lower portion thereof abuts a leaf spring 385. Leaf spring 385 is attached to rotary arm 380, and has a projecting portion in the middle part thereof, as shown in FIG. 30(*a*). When pivot shaft 311 rotates, the projecting portion strongly abuts pipe-like portion 384, thereby rotary arm 380 receives strong friction from fixed arm 381. This serves as a braking function, thus presenting an additional anti-vibration effect.

Thirteenth Embodiment

Figure 31:
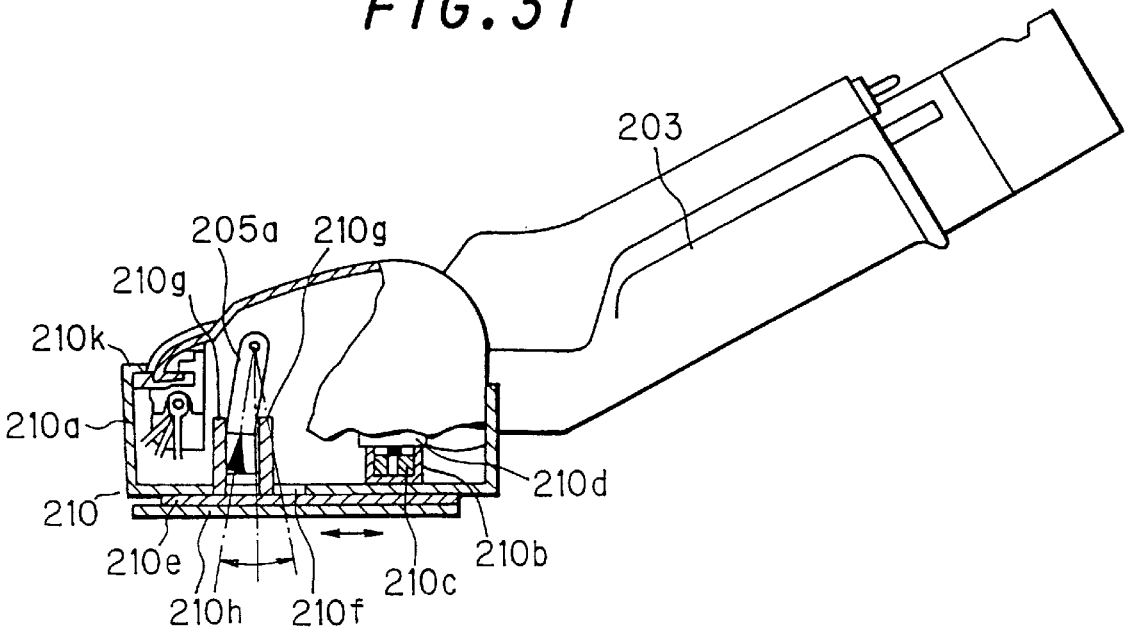
FIG. 31 is a sectional side view showing a suction tool for an electric vacuum cleaner in accordance with the thirteenth embodiment of the invention.

In this embodiment, a floor polisher assembly is provided in the undersurface of suction tool body 201. FIG. 31 shows a suction tool with a floor polisher assembly 210. Floor polisher assembly 210 includes: a device frame 210*a* of a rectangular box with its top open so that it can fit to the lower part of suction tool body 201; a magnet 210*c* which is fixed to a magnet socket 210*b* formed in the undersurface of device frame 210*a* and attached to a steel plate 210*d* fixed inside suction tool body 201 when device frame 210*a* is fitted to suction tool body 201; a slider plate 210*e* which is attached to the lower face of device frame 210*a* so as to able to be slide back and forth; a pair of engaging plates 210*g* which are formed upright, one before and the other behind in parallel to one another, on the upper surface of slider plate 210*e* with their upper ends inserted through a slider orifice 210*f* as an opening in the bottom face of device frame 210*a*, into suction tool body 201 so as to engage the lower end of the aforementioned crank 205*a*; and a polishing material 210*h* such as sponge, felt, etc., attached to the undersurface of slider plate 210*e*.

Figure 32:
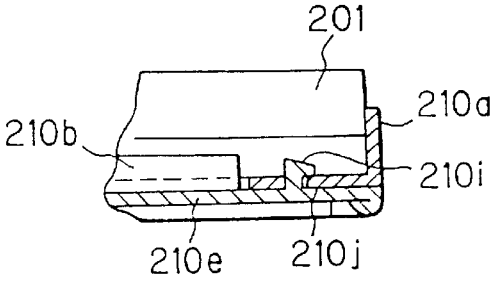
FIG. 32 is a sectional front view showing essential components of a suction tool for an electric vacuum cleaner in accordance with the thirteenth embodiment of the invention.

Slider plate 210*e* has a pair of engaging portions 210*i* on the upper face at both ends with respect to the length as shown in FIG. 32. Engaging portions 210*i* are caught by engagement slots 210*j*, 210*j* which open in the front to back direction at both ends on the bottom surface of device frame 210*a*, so that slider plate 210*e* can slide forwards and backwards in the undersurface of device frame 210*a*.

Since crank 205*a* is engaged between engaging plates 210*g*, 210*g*, movable brush 205*e* formed at the lower end of this crank is also located between engaging plates 210*g*, 210*g*. Provided at the upper front edge of device frame 210*a* is an engaging portion 210*k* formed of a bent portion. When device frame 210*a* is attached to suction tool body 201, engaging portion 210*k* engages the upper front edge of the suction tool body so that it can prevent, in cooperation with the attractive force of magnet 210*c*, the device frame from coming off.

In the above configuration, when the floor polisher assembly is used, floor polisher assembly 210 is attached to suction tool body 201, as shown in the drawing. When an unillustrated switch for polishing is turned on, only driver device 204 is energized whilst the motor for suction is inactivated, Following the oscillation of crank 205*a* with the reciprocating motion of rod 204*b*, slider plate 210*e* is made to slide back and forth by means of engaging plates 210*g*, thus floor polishing material 210*h* stretched across the undersurface of slider plate 210*e* can polish the floor surface. When the floor polishing is complete, floor polisher assembly 210 can be removed from suction tool body 201.

Fourteenth Embodiment

Figure 33:
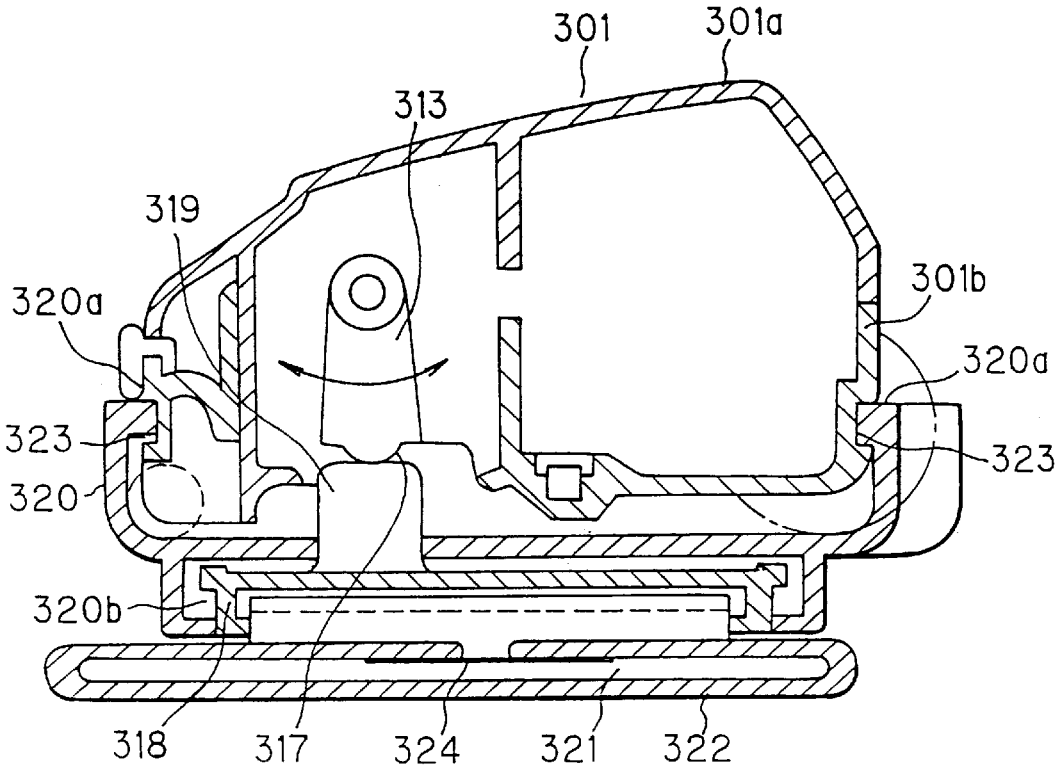
FIG. 33 is a sectional side view showing essential components of a suction tool for an electric vacuum cleaner in accordance with the fourteenth embodiment of the invention.

FIG. 33 is a view showing a floor polisher assembly (waxing polisher) attached to a suction tool body. A vibrating cam 317 is formed at the lower end of the arm plate 313 shown in the eleventh embodiment. An abutting projection 319 is formed in a vibrating plate 318 so as to be located opposite vibrating cam 317. This vibrating plate 318 is mounted to an attachment frame plate 320, which is attached to suction tool body 301, and the plate 318 has a polishing plate 321 with a polisher cloth 322 attached underneath it.

Figure 34:
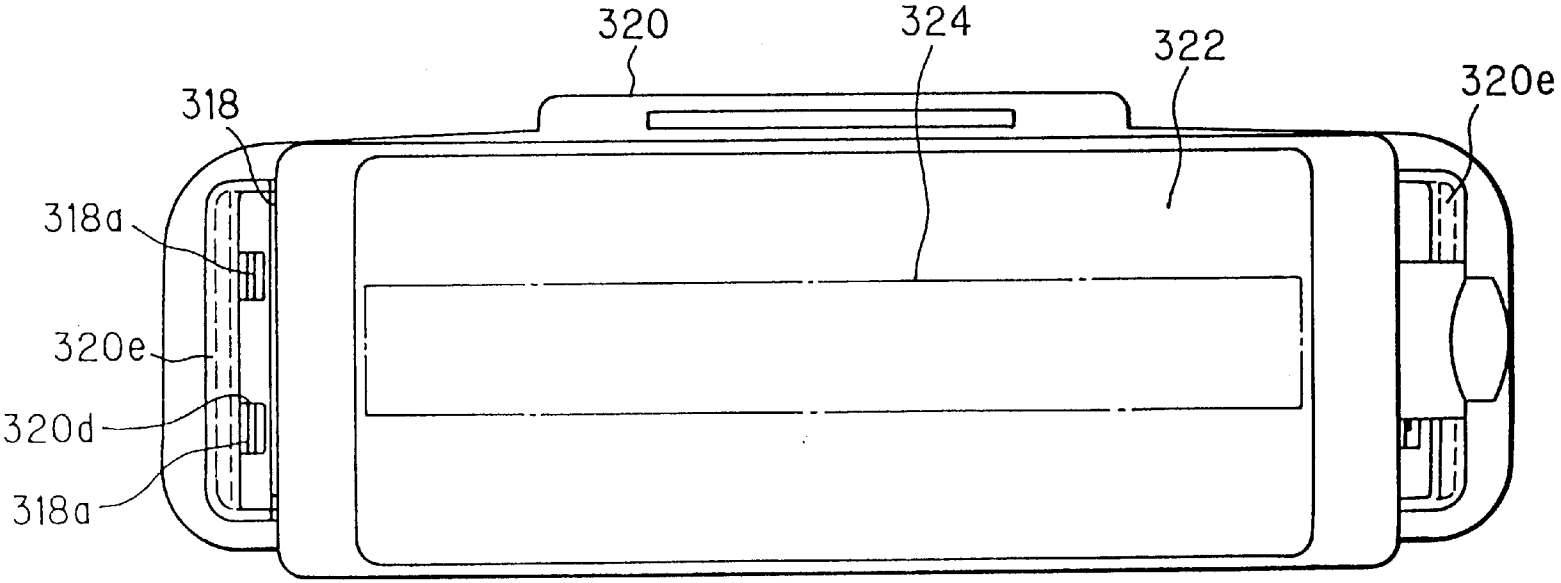
FIG. 34 is a view for the illustration of how to attach the vibrating plate of a suction tool for an electric vacuum cleaner in accordance with the fourteenth embodiment of the invention.

Attachment frame plate 320 is in the form of a rectangular inverted tray-like frame, and has a pair of engaging projections 320*a* on the inner sides of the front and rear walls. These engaging projections 320*a* engage with engaging recesses 323 of lower casing 301*b* so as to attach to this lower casing 301*b*. This attachment frame plate 320 has a vibrating plate receptacle 320*b* therebeneath for receiving the vibrating plate 318. A pair of catching portions 320*c*, 320*c* for securing both ends of vibrating plate 318 are provided at both ends of attachment frame plate 320, as shown in FIGS. 34 and 35.

Figure 35:
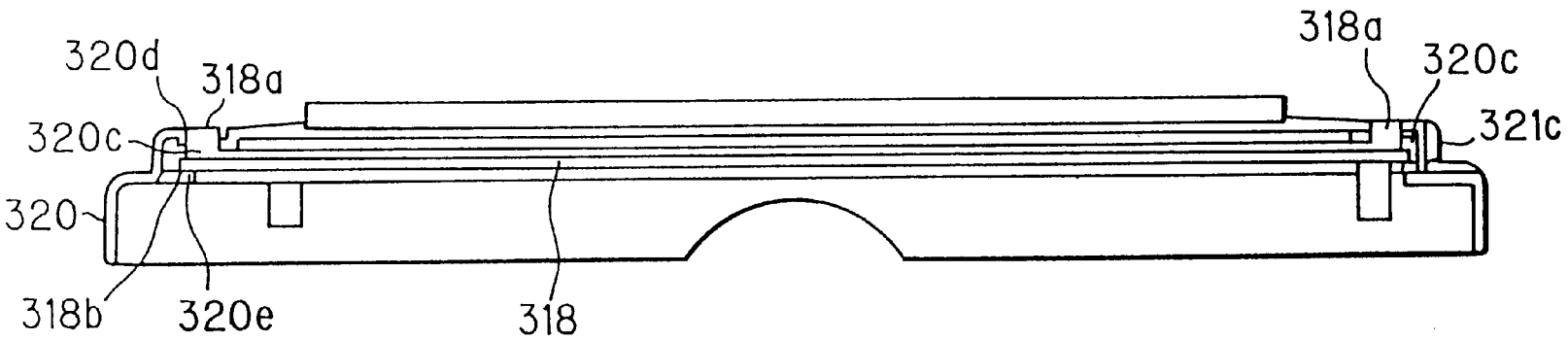
FIG. 35 is a view illustrating the relation between the vibrating plate and the attachment frame plate in a suction tool for an electric vacuum cleaner in accordance with the fourteenth embodiment of the invention.
Figure 36:
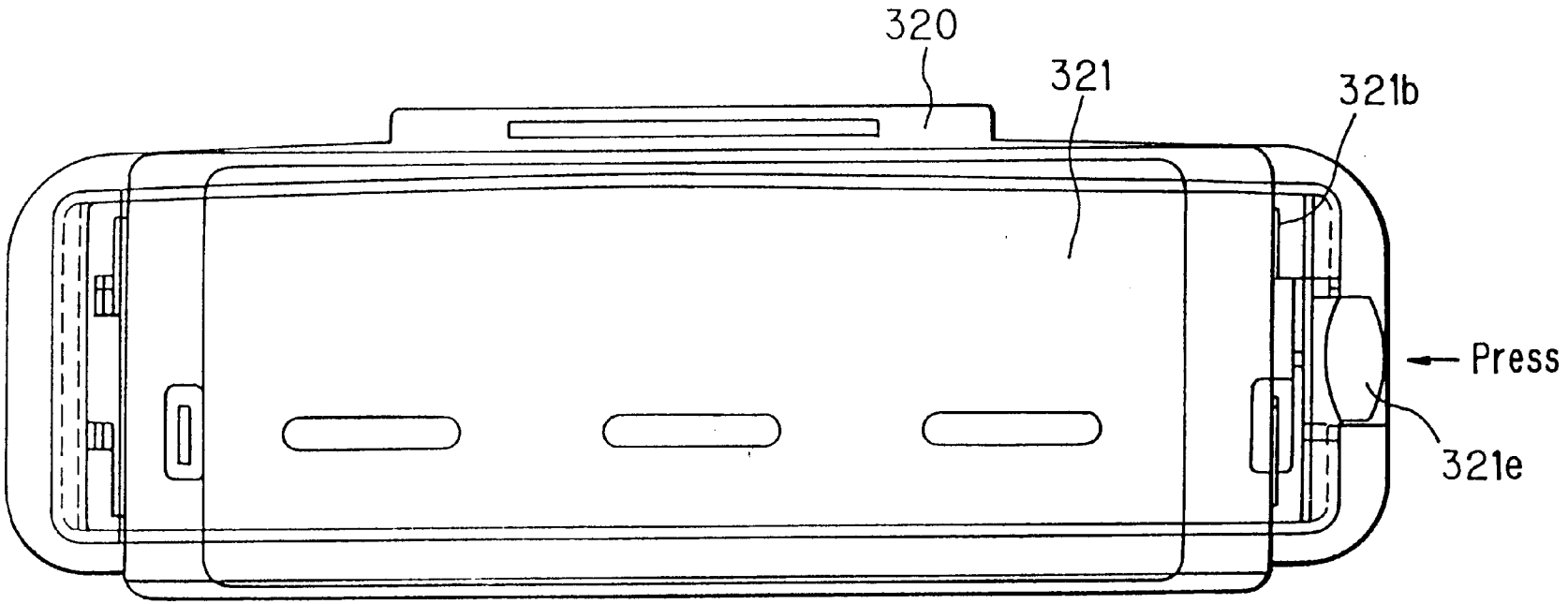
FIG. 36 is a bottom view illustrating the attached relationship between the brushing plate and the vibrating plate in a suction tool for an electric vacuum cleaner in accordance with the fourteenth embodiment of the invention.
Figure 37:
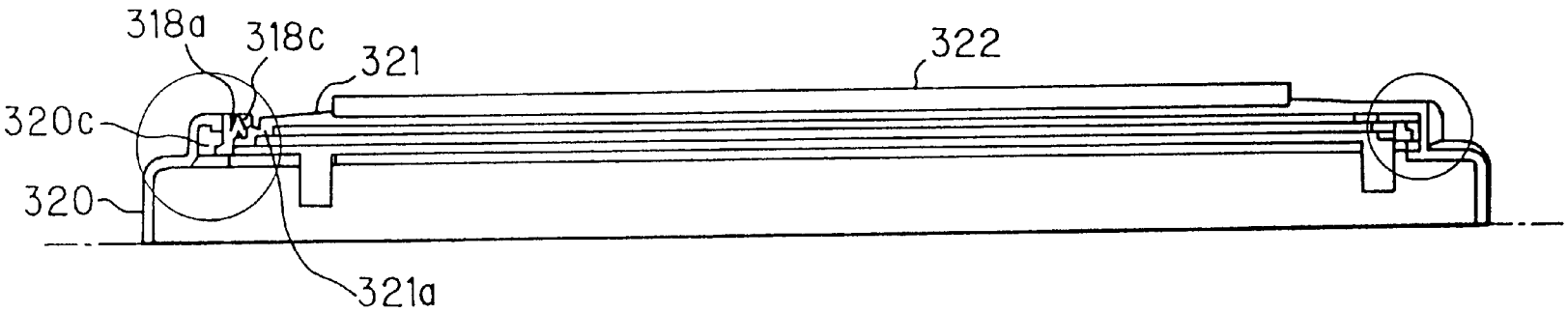
FIG. 37 is a front view illustrating the attached relationship between the brushing plate and the vibrating plate in a suction tool for an electric vacuum cleaner in accordance with the fourteenth embodiment of the invention.
Figure 38:
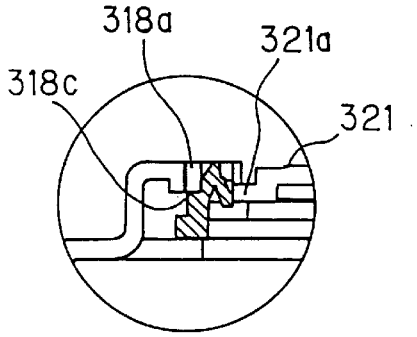
FIG. 38 is a partially enlarged view of FIG. 37.
Figure 39:
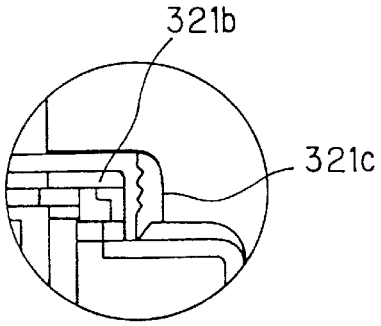
FIG. 39 is a partially enlarged view of FIG. 38.

FIG. 35 most clearly shows the fitted relationship of catching portions 320*c*, 320*c* to both ends of vibrating plate 318. As is apparent from this figure, an engaging part 318*a* formed in each end of vibrating plate 318 fits to a corresponding engaging hole 320*d* of catching portion 320*c* while an engaging edge 318*b* at each side of vibrating plate 318 is caught by engaging part 320*e* of catching portion 320*c*.

In this arrangement, since the height of catching portion 320*c* is greater than that of vibrating plate 318, vibrating plate 318 can move up and down after the two ends of vibrating plate 318 are fitted to catching portions 320*c*. Accordingly, when vibrating plate 318 is attached to attachment frame plate 320 so that the two ends of plate 318 engage catching portions 320*c*, the main structure of vibrating plate 318 is held by vibrating plate receptacle 320*b*. Designated at 318*d* is a cushioning material which is provided inside vibrating plate 318 and is formed of foam rubber. This lends itself to prevention of damage to flooring and reduction of noise.

Next, the method for attachment of polishing plate 321 to vibrating plate 318 will be explained. In this case, first, polishing cloth 322 is attached to polishing plate 321. The attachment of polishing cloth 322 is performed by wrapping polishing cloth 322 on polishing plate 321 and fixing two ends of the cloth with a fastening tape 324. In this state, as shown in FIGS. 36 through 39, one end 321*a* of polishing plate 321 is inserted into engaging part 318*a* of vibrating plate 318. When end 321*a* is fitted in, a spring 318*c* which is provided inside engaging part 318*a* as shown in the figure, flexes so as to allow end 321*a* to enter to some extent in the pressed direction.

In this condition, the other end 321*b* of polishing plate 321 is positioned to the other engaging part 318*a* of vibrating plate 318, and thereafter the pressure against the pressing portion (designated at 321*c*) of polishing plate 321 is released. Then, the two ends of polishing plate 321 will engage respective engaging parts 318*a* due to the restoration force of spring 318*c* so that polishing plate 321 is integrated with vibrating plate 318, thereby permitting the use of the floor polisher assembly. Removal of polishing plate 321 can be easily performed by thrusting pressing portion 321*c* against the repulsive force of spring 318*c* and then releasing the engagement between end 321*b* of polishing plate 321 and engaging part 318*a*.

Figure 40:
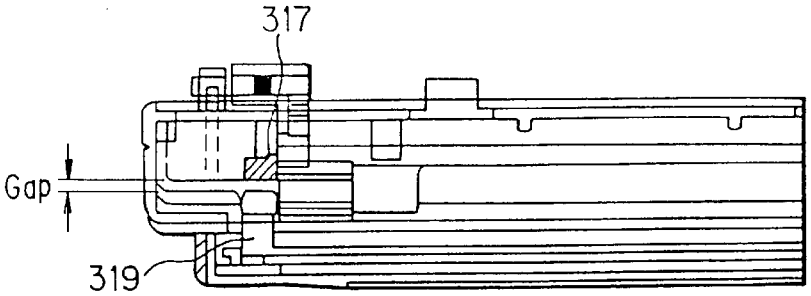
FIG. 40 is a view showing a suction tool for an electric vacuum cleaner in accordance with the fourteenth embodiment of the invention wherein the suction tool is lifted up from the floor surface.
Figure 41:
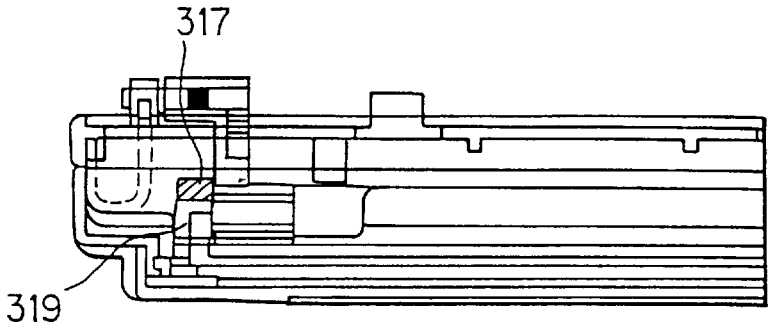
FIG. 41 is a view showing a suction tool for an electric vacuum cleaner in accordance with the fourteenth embodiment of the invention wherein the suction tool is placed on the floor surface.

In this way, as suction tool body 301 with the floor polish device attached thereto, is lifted from the floor surface as shown in FIG. 40, both the vibrating plate 318 and polishing plate 321 lower due to gravity, and consequently, abutting projection 319 comes apart from vibrating cam 317 of arm plate 313 so that the motion of vibrating cam 317 will not be transmitted to the polishing plate through abutting projection 319. When suction tool body 301 is placed on the floor surface as shown in FIG. 41, the whole weight of the suction tool, acts to push up vibrating plate 318 so that vibrating cam 317 abuts abutting projection 319, thus the motion of vibrating cam 317 is transmitted to polishing plate 321 via abutting projection 319.

In the above configuration, when driver device 304 is energized for driving, the driving force is transmitted through driver pulley 306*a*, belt 309, driven pulley 306*b*, offset pin 306*d* and offset link 306*e* to oscillator means 312, so as to sway the oscillator means 312. This oscillation is transmitted to vibrating cam 317 through arm plate 313. Then, vibrating cam 317 thrusts abutting projection 319 as arm plate 313 sways. Vibrating plate 318, receiving the interactive action between the weight of suction tool 301 and thrusting force of vibrating cam 317, moves (vibrates) up and down within attachment frame plate 320, whereby the floor surface is polished by polishing cloth 322.

Figure 42:
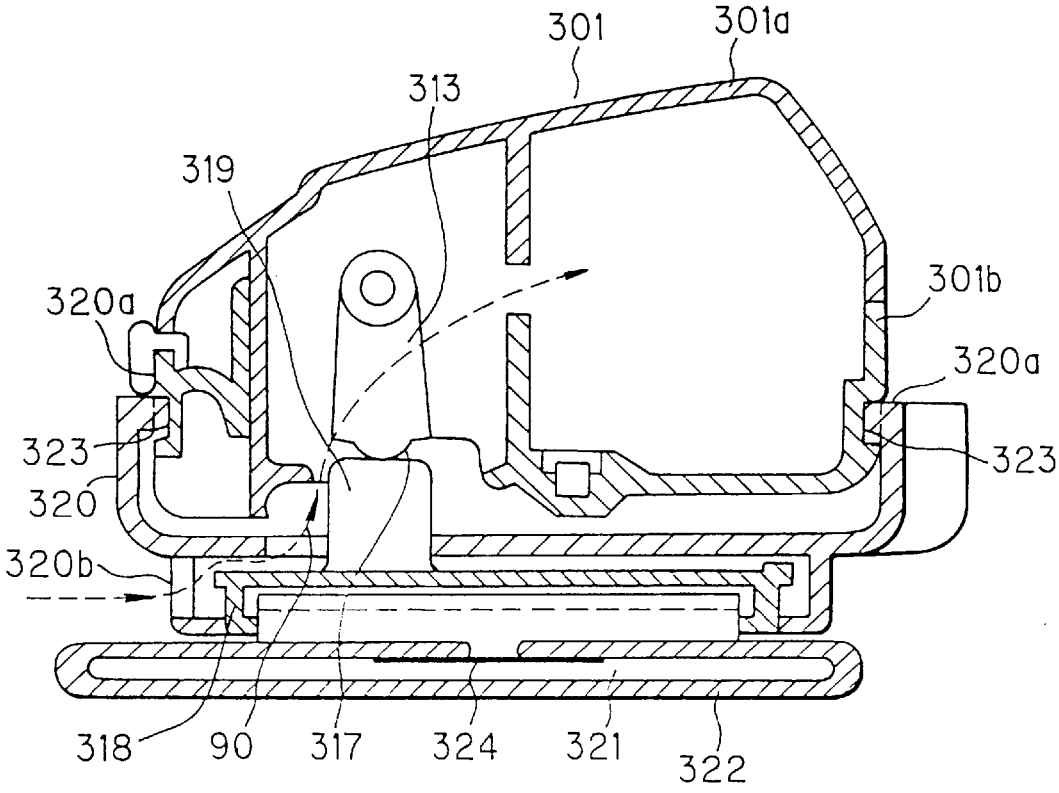
FIG. 42 is a view showing a variation of FIG. 33.

FIG. 42 is a variation of FIG. 33, showing the embodiment of a floor polisher assembly in which a suction inflow channel (indicated by broken line 90) which communicates with suction port 302 of suction tool is provided. In FIG. 42, like reference numerals are allotted to the same components as in FIG. 33. In accordance with the configuration of FIG. 42, when the floor is dry polished without wax by the floor polisher assembly attached to the suction port, it is possible to perform dry polishing while sucking hair, dust and the like from the flooring. Further, when the suction port comes in contact with the wall, it exhibits a maximum suction effect.

As has been seen in the above embodiments, the present invention has the following effects.

In accordance with the first and second features of the invention, since movable brush needs less space for operation as compared to the rotational space that was occupied by the conventional rotary brush, it is possible to reduce suction tool body proportionally. Further, this configuration can be used in safety, i.e., it has no risk of danger that the fingers might be drawn into the tool, unlike the case of rotary brush.

In accordance with third feature of the invention, depending upon the type of the material on the floor, either brush bristles or a blade can be selectively used for convenience by detaching a single movable brush and reversing it upside down.

In accordance with the fourth and fifth features of the invention, the dust and dirt in front of, or at the side of, the rotary brush, that is, in the area which cannot be reached by the conventional rotary brush, can be scrubbed by the second brush, thus it is possible to further improve the effect of collecting dust.

The suction tool for an electric vacuum cleaner in accordance with the sixth feature of the invention, includes: a suction tool body which is connected to the vacuum cleaner body and has a suction inflow passage therein for conducting a suction air stream from a suction port opening on the bottom face thereof, to the vacuum cleaner body; and a movable brush which is provided in the middle of the suction inflow passage inside the suction tool body and is driven by a driver device, wherein the movable brush is supported rotatably inside suction tool body so that the brush is arranged along, and can sway back and forth relative to, the inflow direction of the suction air stream, and the driver device comprises a linear motor or solenoid.

As a result, in accordance with this invention, the provision of only a movable brush which simply oscillates is so effective that it is possible to make the suction tool compact as compared to the conventional brush which was rotated. Still more, the driver device is constituted of a linear motor or solenoid, needing fewer parts, thus a further reduction in size can be expected. Moreover, this configuration is safe, i.e., it is free from the danger that the fingers might be drawn in or any other risk, unlike the conventional rotary brush.

The suction tool for an electric vacuum cleaner of in accordance with the seventh feature, includes: a suction tool body which is connected to the vacuum cleaner body and has a suction inflow passage therein for conducting a suction air stream from a suction port opening on the bottom face thereof, to the vacuum cleaner body; a movable brush which is provided in the middle of the suction inflow passage inside the suction tool body and is driven by a driver device; an oscillator plate which has the movable brush at the lower end thereof and is pivoted inside the suction tool body so as to sway back and forth along the inflow direction of the suction air stream; and a linear motor which constitutes the driver device, and operates so as to reciprocate a rod which is linked at one end thereof with the oscillator plate, wherein the movable brush attached to the oscillator plate sways to perform cleaning, following the reciprocating motion of the rod due to the operation of the linear motor.

Accordingly, in accordance with this invention, the provision of only a movable brush which simply oscillates is enough effective, so that it is possible to make the suction tool compact as compared to the conventional brush which was rotated. Still more, since the driver device is constituted of a linear motor, the driving force of the motor is transmitted to the oscillator plate using only a rod. This configuration needs very few parts, so that a further reduction in size can be expected. Needless to say, this configuration is free from the danger that the fingers might be drawn in or any other risk.

In accordance with the suction tool for an electric vacuum cleaner of the eighth feature of the invention, in the suction tool for an electric vacuum cleaner having the seventh feature, the driver device is constructed by a solenoid. Accordingly, also in this invention, it is possible to provide a suction tool for an electric vacuum cleaner which needs as few parts as in the invention of the seventh feature.

The suction tool for an electric vacuum cleaner in accordance with the ninth feature includes: a suction tool body which is connected to the vacuum cleaner body and has a suction inflow passage therein for conducting a suction air stream from a suction port opening on the bottom face thereof, to the vacuum cleaner body; a movable brush which is provided in the middle of the suction inflow passage inside the suction tool body and is driven by a driver device; an oscillator plate which is pivoted inside the suction tool body so as to sway back and forth along the inflow direction of the suction air stream; a sweeping member made from rubber, attached to the lower end of the oscillator plate; a movable brush which is attached to the lower end of the oscillator plate behind the sweeping member so as to project downward; and a linear motor or solenoid which constitutes the driver device and operates so as to reciprocate a rod which is linked at one end thereof with the oscillator plate, wherein the movable brush attached to the oscillator plate sways to perform cleaning, following the reciprocating motion of the rod due to the operation of the linear motor or solenoid.

Accordingly, in accordance with this invention, the provision of only a movable brush which simply oscillates is so effective that it is possible to make the suction tool compact as compared to the conventional brush which was rotated. Still more, since the driver device is constituted of a linear motor or solenoid, the driving force of the motor is transmitted to the oscillator plate using only a rod. This configuration needs very few parts, so that a further reduction in size can be expected. Further, the provision of a sweeping member enables lint and fluff adhering to carpet etc., to be scrubbed efficiently, thus enhancing cleaning efficiency.

Next, the suction tool for an electric vacuum cleaner in accordance with the tenth feature includes: a suction tool body which is connected to the vacuum cleaner body and has a suction inflow passage therein for conducting a suction air stream from a suction port opening on the bottom face thereof, to the vacuum cleaner body; and a movable brush unit which is provided in the middle of the suction inflow passage inside the suction tool body and reciprocates back and forth by a driver device. The movable brush unit is composed of a unit base frame extending along the suction port and a movable brush assembly attached to the unit base frame, and the movable brush assembly is composed of a sweeping member which is made from a rubber material and includes a base part which fits into the unit base frame, a pair of front and rear sweeping parts which extend downward in parallel to one another with a gap therebetween, from the lower side of the base part, and a movable brush embedded in the gap, wherein the front sweeping part is shorter than the rear sweeping part.

In accordance with this invention, the movable brush unit is swayed and reciprocated by the operation of the driver device so that the movable brush and sweeping member of the movable brush unit performs cleaning. Accordingly, the provision of only a movable brush which simply oscillates is so effective that it is possible to make the suction tool compact as compared to the conventional brush which was rotated. Still more, since the front sweeping part is formed shorter than the rear sweeping part, the structure enables lint and fluff adhering to carpet etc., to be scrubbed efficiently, thus enhancing cleaning efficiency.

In the suction tool for an electric vacuum cleaner according to the eleventh feature of the invention, the pivotal shaft of the movable brush unit is supported through an anti-vibration mechanism. Accordingly, in accordance with the invention, during the operation of the movable brush unit, cleaning is performed whilst vibrations are absorbed by the anti-vibration mechanism. Thus, if the movable brush unit vibrates, the vibration can be alleviated so as not to be transmitted to the whole part of the suction tool. Therefore, it is possible to provide an electric vacuum cleaner having good handling, in which the vibration will not spread to the hands of the user.

The suction tool for an electric vacuum cleaner in accordance with the twelfth feature of the invention, includes: a suction tool body which is connected to the vacuum cleaner body and has a suction inflow passage therein for conducting a suction air stream from a suction port opening on the bottom face thereof, to the vacuum cleaner body; and a movable brush unit which is provided in the middle of the suction inflow passage inside the suction tool body and reciprocates back and forth by a driver device, and the movable brush unit is composed of a unit base frame extending along the suction port and a movable brush assembly attached to the unit base frame while the movable brush assembly is composed of a sweeping member which is made from a rubber material and includes a base part which fits into the unit base frame, a pair of front and rear sweeping parts which extend downward in parallel to one another with a gap therebetween, from the lower side of the base part, and a movable brush embedded in the gap, wherein the movable brush is impregnated with liquid paraffin.

Thus, since the movable brush is impregnated with liquid paraffin, this feature can offer a simple floor polishing effect for the flooring.

The thirteenth configuration of the invention, further comprises an angular motion regulatory mechanism for regulating the reciprocating motion of the movable brush about the pivotal shaft. Accordingly, the vibration of the movable brush as well as deformation of the unit base frame is inhibited during the swaying and reciprocating motion, thus making it possible to obtain a reliable sweeping effect of the movable brush.

In the suction tool for an electric vacuum cleaner in accordance with the fourteenth feature of the invention, the angular motion regulatory mechanism has such a structure that a rotary member fixed to the pivotal shaft is angularly restricted by an immovable member, and a leaf spring is interposed between the rotary member and the immovable member so that braking force is generated through the leaf spring within the range in which the rotary member is movable. As a result, it is possible to reliably inhibit the vibration of the movable brushing unit by an inexpensive method.

Further, the suction tool for an electric vacuum cleaner in accordance with the fifteenth feature of the invention, includes: a suction tool body which is connected to the vacuum cleaner body and has a suction inflow passage therein for conducting a suction air stream from a suction port opening on the bottom face thereof, to the vacuum cleaner body; a floor polisher assembly which is attached to the lower side of the suction tool body so as to slide back and forth; a linear motor or solenoid for reciprocating a rod provided inside the suction tool body; a transmission device which transmits the motion of the rod to the floor polisher assembly so as to reciprocate the floor polisher assembly back and froth in the undersurface of the suction tool body, following the reciprocating motion of the rod due to the linear motor or solenoid.

As a result, in accordance with this invention, the floor polishing assembly moves back and forth in the undersurface of the suction tool body by the operation of the linear motor or solenoid. In this way, the electric vacuum cleaner can be used as a floor polisher, thus it is possible to provide an electric vacuum cleaner having good handling.

The suction tool for an electric vacuum cleaner in accordance with the sixteenth feature of the invention, includes: a suction tool body which is connected to the vacuum cleaner body and has a suction inflow passage therein for conducting a suction air stream from a suction port opening on the bottom face thereof, to the vacuum cleaner body; a polishing plate which has a polisher cloth attached on the plate surface thereof and is mounted in the undersurface of the suction tool body so as to be able to vibrate up and down; and a vibrating cam which is driven by a driver device provided inside the suction tool body and vibrates the polishing plate up and down.

Therefore, in accordance with this invention, the polisher cloth polishes the floor surface whilst the polishing plate vibrates up and down, so that it is possible to polish the floor surface without strongly rubbing it. As a result, polishing can be performed without damage to the floor surface.

In accordance with the seventeenth feature of the invention, in the suction tool for an electric vacuum cleaner having the sixteenth feature, the polisher cloth is removably attached to the polishing plate. This configuration permits the polisher cloth to be freely detached from the polishing plate, thus ensuring a markedly easier replacement of the polisher cloth.

The suction tool for an electric vacuum cleaner in accordance with the eighteenth feature of the invention, includes: a suction tool body which is connected to the vacuum cleaner body and has a suction inflow passage therein for conducting a suction air stream from a suction port opening on the bottom face thereof, to the vacuum cleaner body; a polishing plate which has a polisher cloth attached on the plate surface thereof and is mounted in the undersurface of the suction tool body so as to be able to vibrate up and down; and a vibrating cam which is driven by a driver device provided inside the suction tool body and vibrates the polishing plate up and down, wherein when the suction tool body is placed on the floor surface, the vibrating cam becomes mechanically linked with the polishing plate so that the motion of the vibrating cam is transmitted to the polishing plate to vibrate the polishing plate.

In accordance with this invention, the vibrating cam becomes mechanically linked with the polishing plate so that the motion of the vibrating cam can be transmitted to the polishing plate so to vibrate only when the suction tool body is placed on the floor surface. As a result, when the suction tool body is lifted, in other words, when the user lifts up the suction tool body for transfer, or any other reason, the vibrating cam is not mechanically linked with the polishing plate. Therefore, it is possible to provide a suction tool which is free from the danger that the fingers might be drawn into the gap between the polishing plate and the suction tool.

The suction tool for an electric vacuum cleaner in accordance with the nineteenth feature of the invention, includes: a suction tool body which is connected to the vacuum cleaner body and has a suction inflow passage therein for conducting a suction air stream from a suction port opening on the bottom face thereof, to the vacuum cleaner body; a polishing plate which has a polisher cloth attached on the plate surface thereof and is mounted in the undersurface of the suction tool body so as to be able to vibrate up and down; and a vibrating cam which is driven by a driver device provided inside the suction tool body and vibrates the polishing plate up and down, a floor polishing device having a suction inflow passage communicating with the suction tool body.

Accordingly, when the floor is dry polished without wax by the floor polisher attached to the suction port, it is possible to perform dry polishing while sucking hair, dust and the like from the flooring. Further, when the suction port comes in contact with the wall, it exhibits a maximum suction effect.

What is claimed is:

1. A suction tool for an electric vacuum cleaner comprising:

a suction tool body which is connected to the vacuum cleaner body and has a suction inflow passage therein for conducting a suction air stream from a suction port opening on the bottom face thereof, to the vacuum cleaner body; and a movable brush which is provided in the middle of the suction inflow passage inside the suction tool body and is driven by a driver device, wherein a linear support shaft is located above the movable brush, and means for connecting the movable brush to the support shaft, the movable brush which is driven by a motor is arranged so as to linearly reciprocate in the left and right directions relative to the inflow direction of the suction air stream.

2. A suction tool for an electric vacuum cleaner according to claim 1 wherein the means for connecting includes a plurality of outer support plates.

3. A suction tool for an electric vacuum cleaner according to claim 2:

wherein the support plates are effective to move in the lateral direction along the support shaft.

4. A suction tool for an electric vacuum cleaner according to claim 2:

further including;

a rotary piece with a cam surface, the rotary piece located adjacent a single support plate.

5. A suction tool for an electric vacuum cleaner according to claim 4:

further including;

a projection on the support plate abuting on a cam surface of the rotary piece.

6. A suction tool for an electric vacuum cleaner according to claim 5:

wherein the cam surface is a slanted surface.

7. A suction tool for an electric vacuum cleaner according to claim 2:

further including;

an elastic member located between an outer surface of a support plate and a bearing, so that the movable brush is urged toward a rotary piece.

8. A suction tool for an electric vacuum cleaner according to claim 7:

wherein the elastic member is a coil spring.

9. A suction tool for an electric vacuum cleaner according to claim 11:

further including;

means for changing a rotary motion of the motor to linear motion of the movable brush.

10. A suction tool for an electric vacuum cleaner according to claim 1, wherein the movable brush is solely a single brush that moves solely in the right and left direction.

* * * * *